US011105272B2

(12) United States Patent
Moriya et al.

(10) Patent No.: US 11,105,272 B2
(45) Date of Patent: Aug. 31, 2021

(54) THROTTLE DEVICE

(71) Applicant: MIKUNI CORPORATION, Tokyo (JP)

(72) Inventors: Sho Moriya, Kanagawa (JP); Keigo Suzuki, Kanagawa (JP); Masaki Hiei, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 16/756,852

(22) PCT Filed: Jan. 10, 2019

(86) PCT No.: PCT/JP2019/000529
§ 371 (c)(1),
(2) Date: Apr. 17, 2020

(87) PCT Pub. No.: WO2019/150906
PCT Pub. Date: Aug. 8, 2019

(65) Prior Publication Data

US 2020/0240333 A1 Jul. 30, 2020

(30) Foreign Application Priority Data

Feb. 2, 2018 (JP) ..... JP2018-016915

(51) Int. Cl.
*F02D 9/02* (2006.01)
*F02D 9/10* (2006.01)
*F02D 11/10* (2006.01)

(52) U.S. Cl.
CPC ..... *F02D 9/02* (2013.01); *F02D 9/1065* (2013.01); *F02D 9/105* (2013.01); *F02D 11/107* (2013.01);
(Continued)

(58) Field of Classification Search
CPC ..... F02D 9/02; F02D 9/1065; F02D 9/105; F02D 11/107; F02D 2009/0269; F02D 2009/0277
(Continued)

(56) References Cited

U.S. PATENT DOCUMENTS 5,168,852 A 12/1992 Moriguchi et al.
5,492,097 A 2/1996 Byram et al.
(Continued)

FOREIGN PATENT DOCUMENTS

JP S5756635 4/1982
JP H02252927 10/1990
(Continued)

OTHER PUBLICATIONS

"International Search Report (Form PCT/ISA/210) of PCT/JP2019/000529," dated Feb. 19, 2019, with English translation thereof, pp. 1-4.
(Continued)

*Primary Examiner* — Mahmoud Gimie
(74) *Attorney, Agent, or Firm* — JCIPRNET

(57) ABSTRACT

A throttle device includes a default mechanism. The default mechanism includes: a defining portion arranged on the body to define the default position; a first rotation body which rotates integrally with the valve shaft; a second rotation body which can rotate relative to the valve shaft and which engages with the defining portion to limit the rotation in a valve-closing direction; a first urging spring which is interposed between the first rotation body and the body and urges the first rotation body in the valve-closing direction; and a second urging spring which is interposed between the first rotation body and the second rotation body, and urges so as to draw the first rotation body in a valve-opening direction and draw the second rotation body in the valve-closing
(Continued)

direction to engage the two with each other and to maintain the engagement during the non-operation of the drive source.

11 Claims, 21 Drawing Sheets

(52) U.S. Cl.
CPC ..... *F02D 2009/0269* (2013.01); *F02D 2009/0277* (2013.01)

(58) Field of Classification Search
USPC ..... 123/396
See application file for complete search history.

(56) References Cited

U.S. PATENT DOCUMENTS 6,253,732 B1 * 7/2001 Semeyn, Jr. ..... F02D 9/02 123/396
6,371,080 B1 * 4/2002 Saito ..... F02D 9/1065 123/337
6,626,143 B1 * 9/2003 Wayama ..... F02D 9/00 123/399
10,138,820 B2 * 11/2018 Kohler ..... F02D 11/10
2001/0000574 A1 * 5/2001 Wayama ..... F02D 9/1065 123/337
2002/0029760 A1 * 3/2002 Saito ..... F02D 11/10 123/396
2002/0129791 A1 * 9/2002 Saito ..... F02D 9/1065 123/399
2005/0092956 A1 * 5/2005 Fauni ..... F02D 11/107 251/305
2006/0005809 A1 * 1/2006 Kado ..... F02D 11/10 123/399

FOREIGN PATENT DOCUMENTS

JP H03156132 7/1991
JP H1089096 4/1998
JP 2000110589 4/2000
JP 2006312944 11/2006
JP 2011140912 7/2011
JP 2017101626 6/2017
JP 2017110525 6/2017

OTHER PUBLICATIONS

"Office Action of India Counterpart Application", with English translation thereof, dated Jan. 25, 2021, p. 1-p. 5.

* cited by examiner

THROTTLE DEVICE

CROSS-REFERENCE TO RELATED APPLICATION

This application is a 371 application of the International PCT application serial no. PCT/JP2019/000529, filed on Jan. 10, 2019, which claims the priority benefit of Japan Patent Application No. 2018-016915, filed on Feb. 2, 2018. The entirety of each of the abovementioned patent applications is hereby incorporated by reference herein and made a part of this specification.

BACKGROUND OF THE INVENTION

Technical Field

The present invention relates to a throttle device disposed in an intake system of an engine mounted on a vehicle or the like, particularly to a throttle device equipped with a default mechanism which positions a throttle valve at an aperture position where a vehicle can run automatically (hereinafter referred to as a default position).

Related Art

A conventional throttle device is known which includes a body that defines an intake passage, a valve shaft rotatably supported by the body, a throttle valve fixed to the valve shaft, a gear fixed to an end of the valve shaft, an actuator that applies a rotational drive force to the gear, and a default mechanism that positions the throttle valve at a default position having an aperture larger than an idling aperture between a fully closed position and a fully open position (for example, see patent literature 1).

In the throttle device, the default mechanism includes a protrusion piece which rotates integrally with the gear, an engagement portion which is formed on the body to have the same width as the protrusion piece and defines a default position, and a torsion coil spring which is disposed between the body and the gear around the valve shaft and in which both ends are assembled to sandwich the protrusion piece and the engagement portion.

In the default mechanism, when the valve shaft rotates in a direction in which the throttle valve is open from the default position, one end of the torsion coil spring rotates and urges the protrusion piece so that the valve shaft is rotated in a valve-closing direction to return the throttle valve to the default position.

On the other hand, when the throttle valve rotates in a direction in which the throttle valve is closed from the default position, the other end of the torsion coil spring rotates and urges the protrusion piece so that the valve shaft is rotated in a valve-opening direction to return the throttle valve to the default position.

However, in the above default mechanism, the default position is defined by the width dimension of the engagement portion, the shape of both ends of the torsion coil spring, the width dimension of the protrusion piece, and the like. Accordingly, in order to increase the precision of the default position, it is necessary to manage these dimensions, shapes, and the like with high precision.

In addition, since the default position is defined by the position of the engagement portion formed on the body, it is necessary to set a body having an engagement portion in response to each required specification when the default position is changed in response to the specifications of an engine.

Furthermore, since the default mechanism is disposed on the side of the body, it is necessary to integrally dispose components as much as possible.

LITERATURE OF RELATED ART

Patent Literature

Patent literature 1: U.S. Pat. No. 5,492,097

SUMMARY

Problems to be Solved

The present invention has been made in view of the above circumstances, and aims to provide a throttle device which is capable of easily setting and adjusting the default position and achieving integration of components and reduction in device size.

Means to Solve Problems

A throttle device of the present invention includes: a body which defines an intake passage, a valve shaft rotatably supported by the body, a throttle valve fixed to the valve shaft to open and close the intake passage, a drive source which applies a drive force to the valve shaft, and a default mechanism which positions the throttle valve at a default position between a fully closed position and a fully open position; the default mechanism includes: a defining portion arranged on the body to define the default position; a first rotation body which rotates integrally with the valve shaft; a second rotation body which can rotate relative to the valve shaft and which engages with the defining portion to limit the rotation in a valve-closing direction; a first urging spring which is interposed between the first rotation body and the body and urges the first rotation body in the valve-closing direction; and a second urging spring which is interposed between the first rotation body and the second rotation body, and urges so as to draw the first rotation body in a valve-opening direction and draw the second rotation body in the valve-closing direction to engage the two with each other and to maintain the engagement during the non-operation of the drive source.

In the throttle device, a configuration may be employed in which the urging force of the second urging spring is set larger than the urging force of the first urging spring at the default position where the rotation of the second rotation body is limited by the defining portion.

In the throttle device, a configuration may be employed in which the first urging spring and the second urging spring are torsion coil springs disposed around the valve shaft.

In the throttle device, a configuration may be employed in which the first urging spring and the second urging spring are disposed in a nested shape around an axis of the valve shaft or disposed adjacently in an axial direction of the valve shaft.

In the throttle device, a configuration may be employed in which the body includes an accommodation recess that accommodates the second rotation body, the second rotation body is rotatably supported by the valve shaft and disposed in the accommodation recess, and the first rotation body is disposed to face the body and the second rotation body.

In the throttle device, a configuration may be employed in which the first rotation body includes a first latching portion that latches one end of the first urging spring, a second latching portion that latches one end of the second urging spring, and a first engagement portion detachably engaged with the second rotation body; the body includes a third latching portion that latches the other end of the first urging spring; and the second rotation body includes a fourth latching portion that latches the other end of the second urging spring, a second engagement portion detachably engaged with the first engagement portion of the first rotation body, and a contact portion that detachably comes into contact with the defining portion of the body.

In the throttle device, a configuration may be employed in which the body includes a ring-like recess that receives a coil portion of the first urging spring or a coil portion of the second urging spring, and the second rotation body includes a ring-like groove that receives the coil portion of the first urging spring or the coil portion of the second urging spring.

In the throttle device, a configuration may be employed in which the first rotation body includes a recess that receives the coil portion of the first urging spring and a recess that receives the coil portion of the second urging spring.

In the above throttle device, a configuration may be employed in which the defining portion is an adjustment screw screwed to the body.

In the throttle device, a configuration may be employed in which the first rotation body includes a transmission portion with which the drive force of the drive source is transmitted.

In the above throttle device, a configuration may be employed in which a position sensor that detects an aperture position of the throttle valve is included, and the position sensor and the default mechanism are disposed on one side of the body.

Effect

According to the throttle device having the above configuration, it is possible to easily set and adjust the default position, and to achieve integration of components and reduction in device size.

DESCRIPTION OF THE EMBODIMENTS

Figure 1:
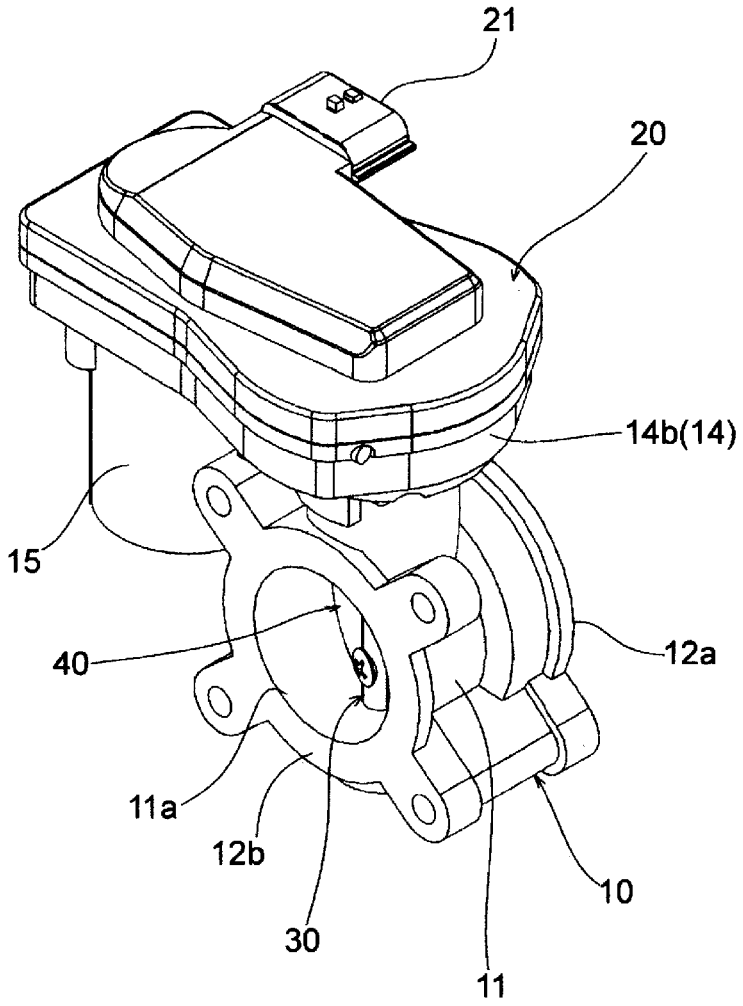
FIG. 1 is an external perspective view showing one embodiment of a throttle device of the present invention.
Figure 2:
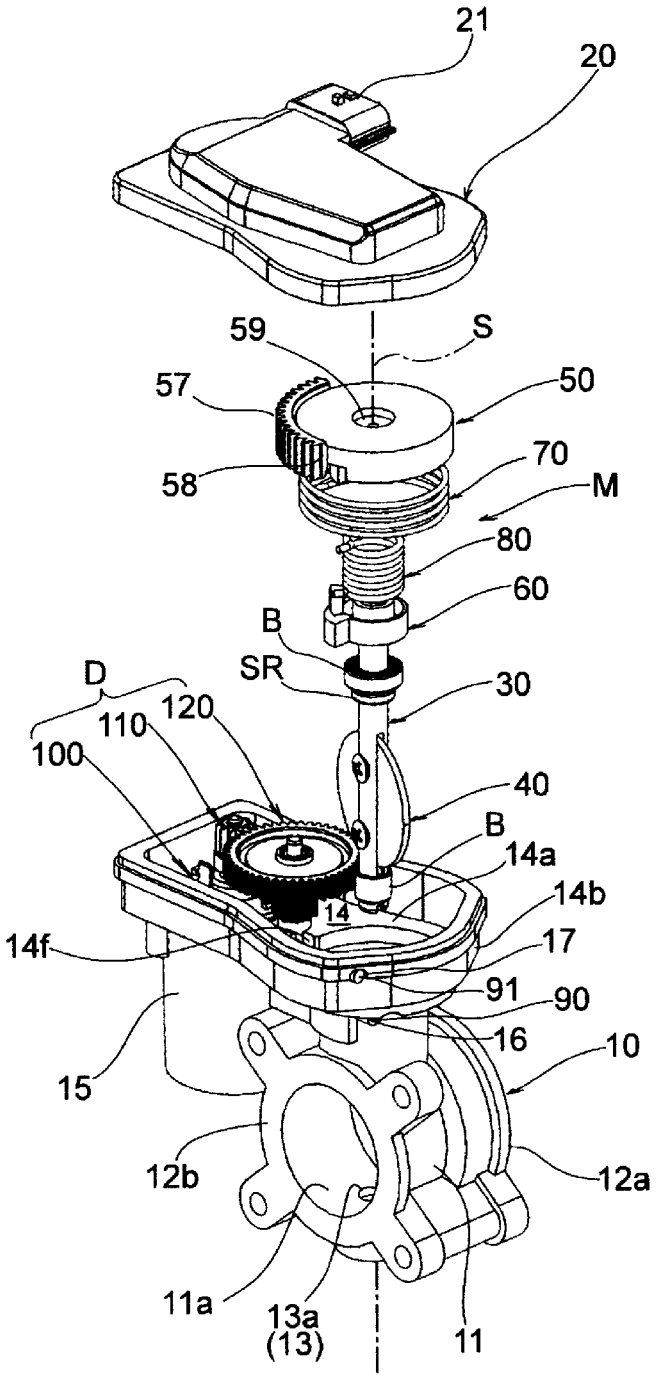
FIG. 2 is an exploded perspective view of the throttle device of one embodiment.
Figure 3:
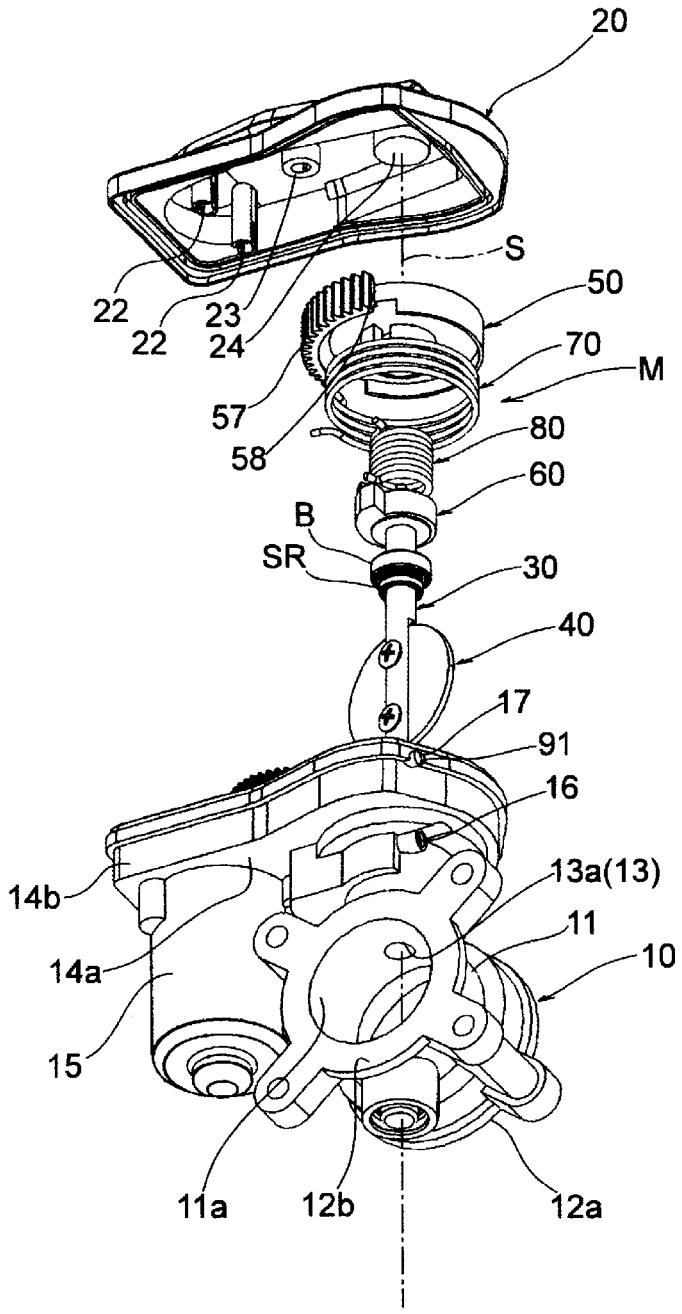
FIG. 3 is an exploded perspective view of the throttle device of one embodiment.
Figure 4:
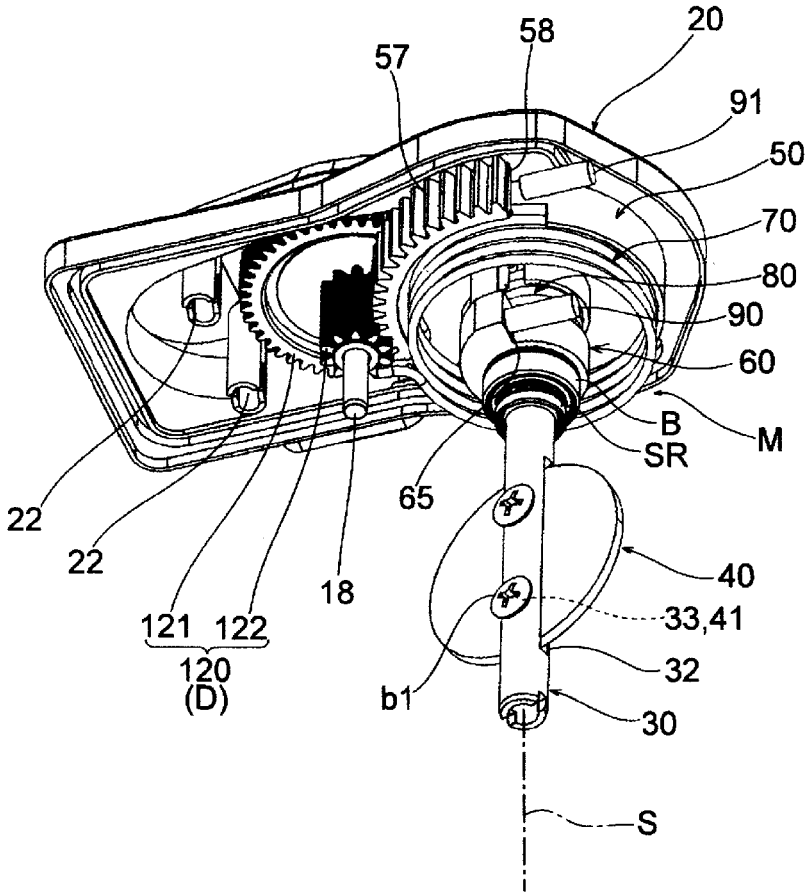
FIG. 4 is a perspective view showing a state in which a body and a drive source are removed in the throttle device of one embodiment.
Figure 5:
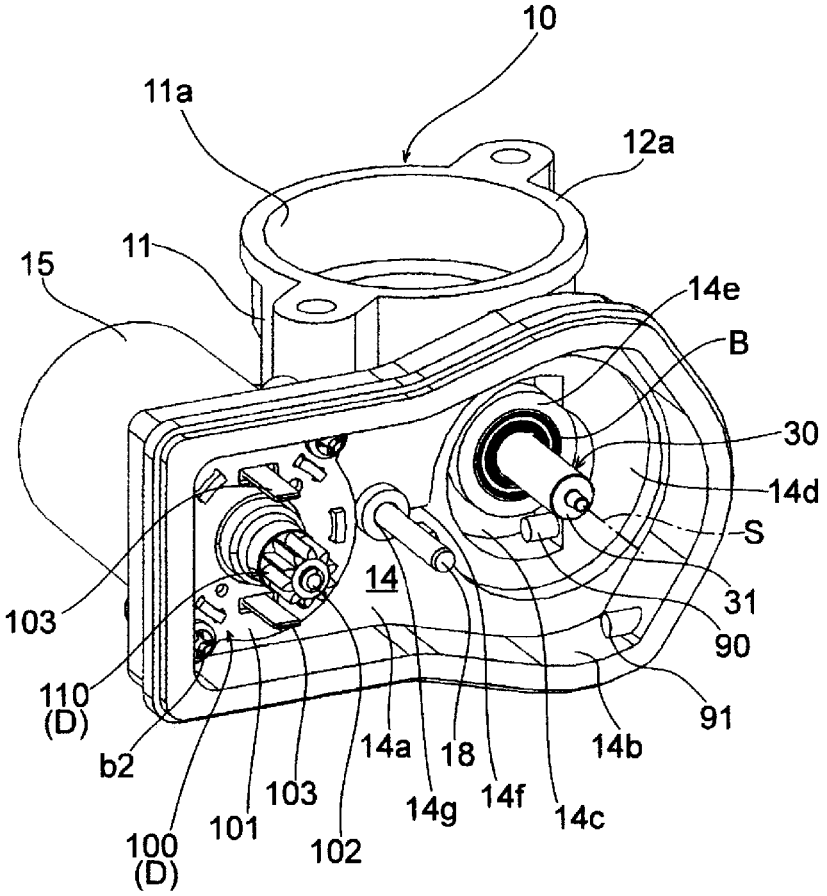
FIG. 5 is a perspective view showing a state in which a cover and a default mechanism are removed in the throttle device of one embodiment.
Figure 6:
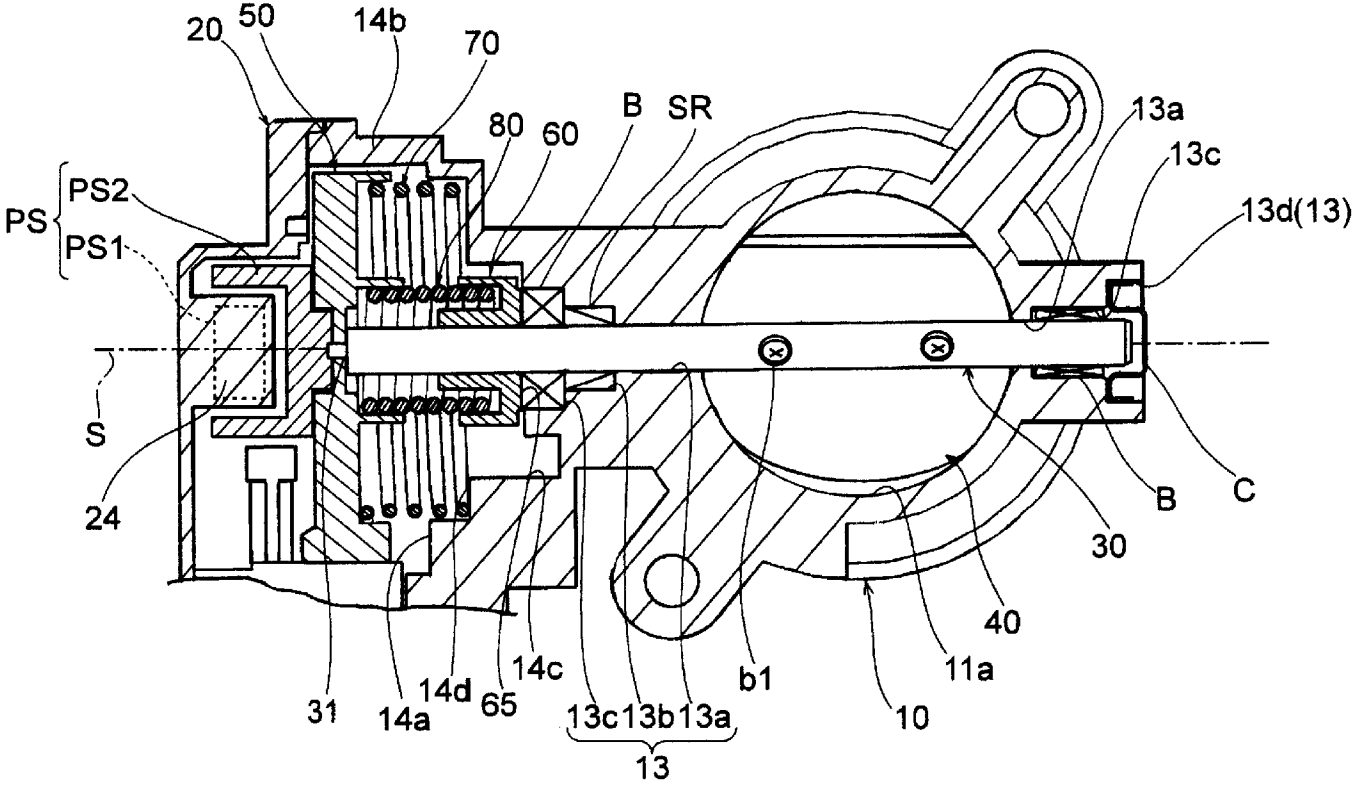
FIG. 6 is a partial cross-sectional view on a plane including an axis of a valve shaft in the throttle device of one embodiment.
Figure 7:
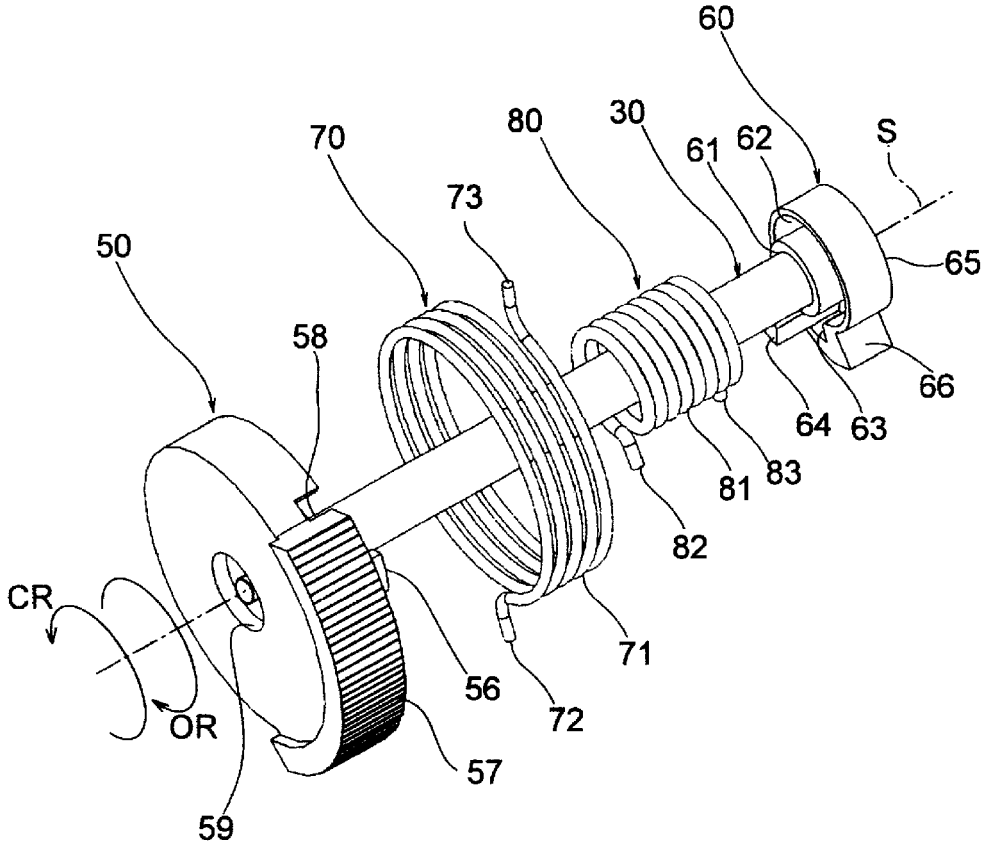
FIG. 7 is an exploded perspective view showing the valve shaft, a first rotation body, a second rotation body, a first urging spring, and a second urging spring included in the throttle device of one embodiment.
Figure 8:
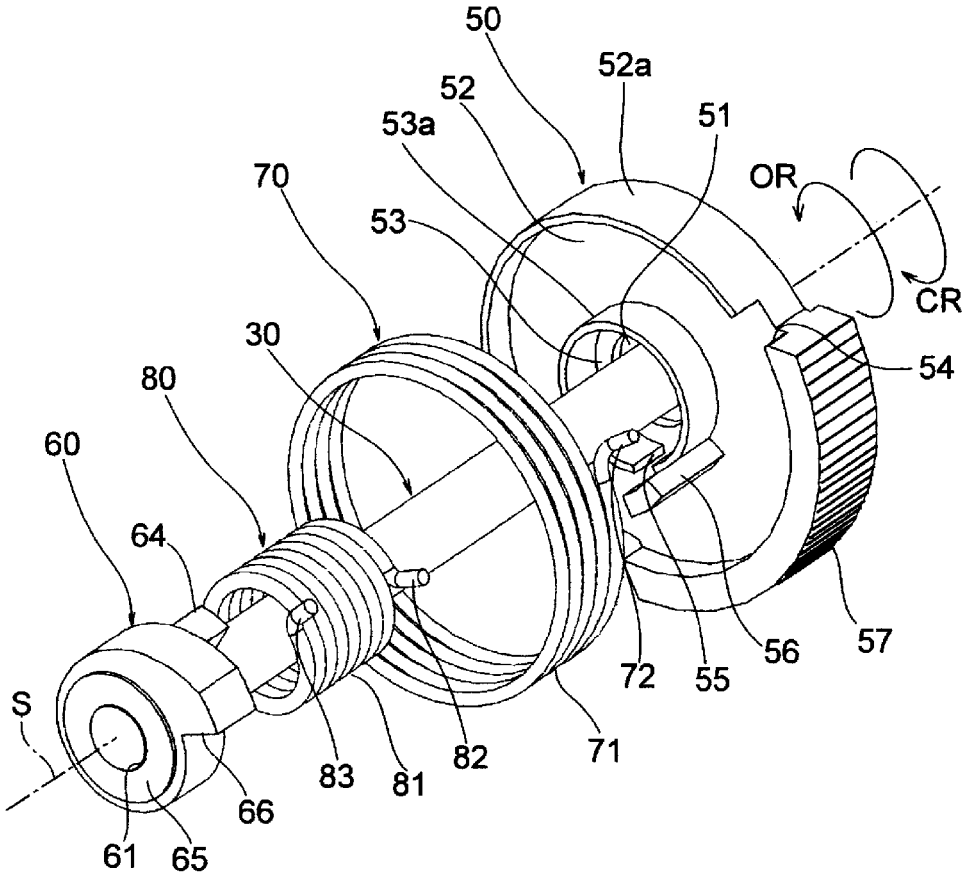
FIG. 8 is an exploded perspective view showing the valve shaft, the first rotation body, the second rotation body, the first urging spring, and the second urging spring included in the throttle device of one embodiment.

Hereinafter, embodiments of the present invention are described with reference to the accompanying drawings.

A throttle device of one embodiment is assembled to an intake system of an engine mounted on a vehicle or the like, and adjusts an amount of intake air flowing through an intake passage. As shown in FIGS. 1 to 8, the throttle device includes a body 10, a cover 20, a valve shaft 30 having an axis S, a throttle valve 40 which rotates together with the valve shaft 30 to open and close the intake passage, a default mechanism M, a drive mechanism D, and a position sensor PS.

The default mechanism M positions the throttle valve 40 at a default position between a fully closed position and a fully open position, the default position has an aperture larger than that of an idling position, and the default mechanism M includes a rotation gear 50 serving as a first rotation body, a rotation holder 60 serving as a second rotation body, a first urging spring 70, a second urging spring 80, and an adjustment screw 90 serving as a defining portion.

The drive mechanism D applies a drive force to the valve shaft 30, and includes a drive source 100, a drive gear 110, and a two-stage gear 120.

The position sensor PS is a magnetic sensor which detects a rotational angle position of the valve shaft 30, that is, an aperture of the throttle valve 40 in a non-contact manner, and includes a detection portion PS1 and a rotor portion PS2.

Besides, the detection portion PS1 includes a stator and a Hall element that are embedded in a columnar portion 24 of the cover 20. The rotor portion PS2 includes an armature and a yoke that are embedded in a cylindrical member joined to a joining portion 59 of the rotation gear 50.

The body 10 is formed of a resin material or a metal material such as aluminum or the like, and includes a tubular portion 11, connection flanges 12*a* and 12*b*, a valve shaft hole 13 through which the valve shaft 30 passes, a recess 14 which accommodates a part of the default mechanism M and the drive mechanism D, a recess 15 which accommodates the drive source 100, a screw hole 16 into which the adjustment screw 90 serving as a defining portion is screwed, a screw hole 17 into which an adjustment screw 91 serving as a fully closed stopper is screwed, and a support shaft 18 fixed to the recess 14.

The tubular portion 11 defines a cylindrical intake passage 11*a* through which intake air flows.

The connection flanges 12*a* and 12*b* are coupled in the middle of a passage member forming the intake system of the engine so that the intake air flows through the intake passage 11*a*.

The valve shaft hole 13 includes a shaft hole 13*a* through which the valve shaft 30 is rotatably passed, a seal hole 13*b* into which a seal SR for sealing the outer periphery of the valve shaft 30 is fitted, a bearing hole 13*c* into which a bearing B which supports the valve shaft 30 to be rotatable is fitted, and a fitting hole 13*d* into which a cap C is fitted.

The recess 14 includes a flat wall portion 14*a* adjacent to the outer wall of the tubular portion 11 and perpendicular to the axis S, a ring-like wall portion 14*b* which surrounds the flat wall portion 14*a*, an accommodation recess 14*c* and a ring-like recess 14*d* formed by cutting out a part of the flat wall portion 14*a* around the axis S, an end surface 14*e*, a latching portion 14*f* serving as a third latching portion, and a fitting hole 14*g*.

The accommodation recess 14*c* is formed on the inner side closer to the intake passage 11*a* than the ring-like recess 14*d* in the direction of the axis S, and accommodates the rotation holder 60 to be rotatable around the axis S in a predetermined angle range while the rotation holder 60 is brought close to the inner side in the direction of the axis S.

That is, the rotation holder 60 is disposed in the accommodation recess 14*c* of the body 10, and thereby it is possible to achieve integration of components and reduction in device width and size in the direction of the axis S of the valve shaft 30. The ring-like recess 14*d* receives a part of a coil portion 71 of the first urging spring 70 so that the part of the coil portion 71 is close to the inner side in the direction of the axis S.

That is, a part of the coil portion 71 of the first urging spring 70 is received by the ring-like recess 14*d* of the body 10, and thereby it is possible to achieve the reduction in device width in the direction of the axis S of the valve shaft 30.

The end surface 14*e* is formed so as to face the rotation holder 60 rotatably supported by the valve shaft 30 in the direction of the axis S. The latching portion 14*f* is formed on a part of the peripheral wall of the ring-like recess 14*d* so as to latch the other end 73 of the first urging spring 70.

The recess 15 has a bottomed cylindrical shape that extends in parallel with the axis S and that opens at the flat wall portion 14*a* so as to accommodate the drive source 100.

The screw hole 16 penetrates from the outside of the body 10 to the wall surface of the accommodation recess 14*c* so that the adjustment screw 90 can be screwed in from the outside and adjusted.

That is, since the adjustment screw 90 is employed as the defining portion, the default position can be easily and precisely set as a position in response to the demand by appropriately adjusting the screwing amount of the adjustment screw 90.

The screw hole 17 penetrates the ring-like wall portion 14*b* forming a part of the body 10 so that the adjustment screw 91 can be screwed in from the outside and adjusted.

That is, since the adjustment screw 91 is employed as a fully closed stopper, the fully closed position can be easily adjusted by appropriately adjusting the screwing amount of the adjustment screw 91.

The support shaft 18 is disposed to extend in parallel with the axis S by a metal material or the like, and is fitted and fixed into the fitting hole 14*g* arranged in the flat wall portion 14*a*.

Besides, the front end of the support shaft 18 is fitted into and firmly held in a fitting hole 23 of the cover 20 in a state that the two-stage gear 120 is rotatably supported.

The cover 20 is formed of a resin material or a metal material such as aluminum or the like, and is joined to the ring-like wall portion 14*b* of the body 10 to cover the recess 14.

The cover 20 includes a connector 21 having terminals which electrically connect the drive source 100 and the position sensor PS to the outside, two female terminals 22 guided from the connector 21 and coupled to the drive source 100, the fitting hole 23 for fitting the front end of the support shaft 18, and the columnar portion 24 which has a center on the axis S and in which the detection portion PS1 of the position sensor PS is embedded.

The two female terminals 22 are detachably fitted and electrically connected to two male terminals 103 of the drive source 100 accommodated in the recess 15.

The valve shaft 30 is formed by a metal material or the like so as to have a circular cross section and extend in the direction of the axis S, and includes a fixation portion 31 which fixes the rotation gear 50 on one end side, a slit 32 for fitting the throttle valve 40 in a substantially central region, and a screw hole 33.

In a state of being disposed through the valve shaft hole 13 of the body 10, the valve shaft 30 holds the throttle valve 40 to be openable and closable by fastening of the throttle valve 40 fitted in the slit 32 with a screw b1.

The throttle valve 40 is formed in a substantially disc shape by a metal material or the like, and includes a circular hole 41 through which the screw b1 passes.

The throttle valve 40 is disposed so as to be passed through the slit 32 and fixed to the valve shaft 30 by the screw b1 after the valve shaft 30 is passed through the valve shaft hole 13, and the throttle valve 40 opens and closes the intake passage 11*a*.

Then, the throttle valve 40 fully closes and fully opens the intake passage 11*a* in response to the rotation of the valve shaft 30, and opens the intake passage 11*a* at each aperture in response to the idling position and the default position.

The rotation gear 50 is formed of a resin material or the like and rotates integrally with the valve shaft 30 with a drive force applied to the rotation gear 50 by the drive mechanism D.

The rotation gear 50 includes a fixation portion 51, a recess 52, a recess 53, a latching portion 54 serving as a first latching portion, a latching portion 55 serving as a second latching portion, a protrusion portion 56 serving as a first engagement portion, a teeth row 57 serving as a transmission portion, a contact portion 58, and a joining portion 59 which joins the rotor portion PS2 of the position sensor PS.

The fixation portion 51 is formed so as to be fitted and fixed to the fixation portion 31 of the valve shaft 30.

The recess 52 is formed so as to be recessed in the direction of the axis S with respect to the teeth row 57 and is formed in an annular shape centering on the axis S to face the body 10 side, receiving a part of the coil portion 71 of the first urging spring 70.

The recess 53 is formed so as to be recessed in the direction of the axis S with respect to the teeth row 57 and is formed in an annular shape centering on the axis S so as to face the rotation holder 60, receiving a part of the coil portion 81 of the second urging spring 80.

In this way, by arranging the recess 52 and the recess 53, the coil portion 71 of the first urging spring 70 is received by the recess 52, and the coil portion 81 of the second urging spring 80 is received by the recess 53. Accordingly, the first urging spring 70 and the second urging spring 80 can be disposed to overlap the rotation gear 50 in the direction of the axis S of the valve shaft 30. Therefore, it is possible to achieve the reduction in device width in the direction of the axis S of the valve shaft 30.

The latching portion 54 is formed by cutting out a part of an outer peripheral wall 52*a* defining the recess 52 so as to latch one end 72 of the first urging spring 70. The latching portion 55 is formed by cutting out a part of an outer peripheral wall 53*a* defining the recess 53 so as to latch one end 82 of the second urging spring 80.

The protrusion portion 56 is formed adjacent to the outer side of the outer peripheral wall 53*a* and to extend in the direction of the axis S so as to detachably engage with a protrusion portion 64 serving as a second engagement portion of the rotation holder 60 around the axis S.

Besides, the protrusion portion 56 can engage with the protrusion portion 64 of the rotation holder 60 when the rotation gear 50 rotates in a valve-opening direction OR, and can be detached from the protrusion portion 64 of the rotation holder 60 when the rotation gear 50 rotates in a valve-closing direction CR.

The teeth row 57 is formed in an arc shape over a predetermined angle range and engaged with a small-diameter gear 122 of the two-stage gear 120, and thereby the drive force of the drive mechanism D is applied to the valve shaft 30.

The contact portion 58 is formed at an end of the teeth row 57, and detachably comes into contact around the axis S with the adjustment screw 91 arranged on the body 10.

That is, the rotation gear 50 rotates in the valve-closing direction CR and the contact portion 58 comes into contact with the adjustment screw 91, and thereby the rotation of the rotation gear 50 and the valve shaft 30 is limited, and the throttle valve 40 is positioned at the fully closed position.

The joining portion 59 is formed so as to fit and fix the rotor portion PS2 of the position sensor PS on a side of the cover 20 facing the columnar portion 24.

The rotation holder 60 is formed of a resin material or the like, and the rotation holder 60 can rotate relative to the valve shaft 30 and engages with the adjustment screw 90 serving as a defining portion when rotating in the valve-closing direction CR to limit further rotation in the valve-closing direction CR.

The rotation holder 60 includes a cylindrical hole 61, a ring-like groove 62, a latching portion 63 serving as a fourth latching portion, the protrusion portion 64 serving as a second engagement portion, an end surface 65, and a contact portion 66 which comes into contact with the adjustment screw 90 serving as a defining portion.

The valve shaft 30 is rotatably fitted into the cylindrical hole 61.

That is, the rotation holder 60 is rotatably supported relative to the valve shaft 30 by passing the valve shaft 30 through the cylindrical hole 61.

The ring-like groove 62 is formed around the cylindrical hole 61 to receive a part of the coil portion 81 of the second urging spring 80.

The latching portion 63 is formed by cutting a part of the outer peripheral wall of the ring-like groove 62 into a groove shape so as to latch the other end 83 of the second urging spring 80.

The protrusion portion 64 is formed to extend in the direction of the axis S so as to detachably engage with the protrusion portion 56 serving as the first engagement portion of the rotation gear 50 around the axis S.

Besides, the protrusion portion 64 can engage with the protrusion portion 56 of the rotation gear 50 when the rotation holder 60 rotates in the valve-closing direction CR, and can be detached from the protrusion portion 56 of the rotation gear 50 when the rotation holder 60 rotates in the valve-opening direction OR.

The end surface 65 comes into contact with the inner ring of the bearing B fitted to the body 10.

The contact portion 66 detachably comes into contact with the adjustment screw 90 around the axis S.

That is, the rotation holder 60 is rotatably supported by the valve shaft 30 and accommodated in the accommodation recess 14*c* of the body 10, and accommodates and holds the second urging spring 80 in the ring-like groove 62.

Accordingly, the rotation holder 60 is disposed in the accommodation recess 14*c* of the body 10, and thereby it is possible to achieve the integration of components and the reduction in device width and size in the direction of the axis S of the valve shaft 30.

In addition, since the coil portion 81 of the second urging spring 80 is received by the ring-like groove 62 of the rotation holder 60, the second urging spring 80 and the rotation holder 60 can be disposed to overlap each other in the direction of the axis S of the valve shaft 30, and it is possible to achieve the reduction in width in the direction of the axis S of the valve shaft 30.

The first urging spring 70 is a large-diameter torsion coil spring interposed between the rotation gear 50 and the body 10 and includes the coil portion 71, one end 72, and the other end 73.

Besides, the first urging spring 70 is disposed around the valve shaft 30 and around the second urging spring 80 held by the rotation holder 60, and the one end 72 is latched by the latching portion 54 of the rotation gear 50 and the other end 73 is latched by the latching portion 14*f* of the body 10 in a state that the coil portion 71 is received by the ring-like recess 14*d* of the body 10 and the recess 52 of the rotation gear 50. In this way, the first urging spring 70 rotates and urges the rotation gear 50 and the valve shaft 30 in the valve-closing direction CR with respect to the body 10.

The second urging spring 80 is a small-diameter torsion coil spring interposed between the rotation gear 50 and the rotation holder 60 and includes the coil portion 81, one end 82, and the other end 83.

Besides, the second urging spring 80 is disposed to be held by the rotation holder 60 around the valve shaft 30, and the one end 82 is latched by the latching portion 55 of the rotation gear 50 and the other end 83 is latched by the latching portion 63 of the rotation holder 60 in a state that the coil portion 81 is received by the ring-like groove 62 of the rotation holder 60 and the recess 53 of the rotation gear 50.

In this way, the second urging spring 80 rotates and urges so as to draw the rotation gear 50 in the valve-opening direction OR and draw the rotation holder 60 in the valve-closing direction CR to engage the protrusion portion 56 of the rotation gear 50 with the protrusion portion 64 of the rotation holder 60.

In addition, the second urging spring 80 applies a rotational urging force to maintain the engagement between the protrusion portion 56 and the protrusion portion 64 during the non-operation of the drive source 100 in which the drive force is not applied.

According to the first urging spring 70 and the second urging spring 80, the rotation gear 50 is rotated and urged in the valve-closing direction CR by the first urging spring 70, and thus the rotation holder 60 which engages with and rotates together with the rotation gear 50 is rotated and urged so that the rotation holder 60 rotates in the valve-closing direction CR and the contact portion thereof comes into contact with the adjustment screw 90 of the body 10.

In this way, the contact portion 66 comes into contact with the adjustment screw 90 and thereby the throttle valve 40 is positioned at the default position.

The drive source 100 applies a rotational drive force to the valve shaft 30, and for example, a DC motor or the like is used.

The drive source 100 includes a main body 101, a rotation shaft 102, and the two male terminals 103.

Besides, the drive source 100 is fixed by a screw b2 with the main body 101 fitted into the recess 15 of the body 10.

A drive gear 110 is fitted and fixed to the rotation shaft 102.

The two male terminals 103 are coupled to the two female terminals 22 by the coupling of the cover 20 to the body 10.

The drive gear 110 is a small-diameter gear and is fitted and fixed to the rotation shaft 102 of the drive source 100, thereby being disposed in the recess 14 of the body 10.

The two-stage gear 120 includes, on the same axis, a large-diameter gear 121 that engages with the drive gear 110 and a small-diameter gear 122 that engages with the teeth row 57 of the drive gear 50.

Besides, the two-stage gear 120 is rotatably fitted to and supported by the support shaft 18 fixed to the body 10.

According to the drive mechanism D including the drive source 100, the drive gear 110, and the two-stage gear 120, when the drive source 100 rotates in one direction, the drive gear 50 and the valve shaft 30 are rotated in the valve-closing direction CR via the drive gear 110, the large-diameter gear 121, the small-diameter gear 122, and the teeth row 57, and the throttle valve 40 rotates in a direction in which the intake passage 11*a* is closed.

On the other hand, when the drive source 100 rotates in another direction, the drive gear 50 and the valve shaft 30 are rotated in the valve-opening direction OR via the drive gear 110, the large-diameter gear 121, the small-diameter gear 122, and the teeth row 57, and the throttle valve 40 rotates in a direction in which the intake passage 11*a* is opened.

Figure 9:
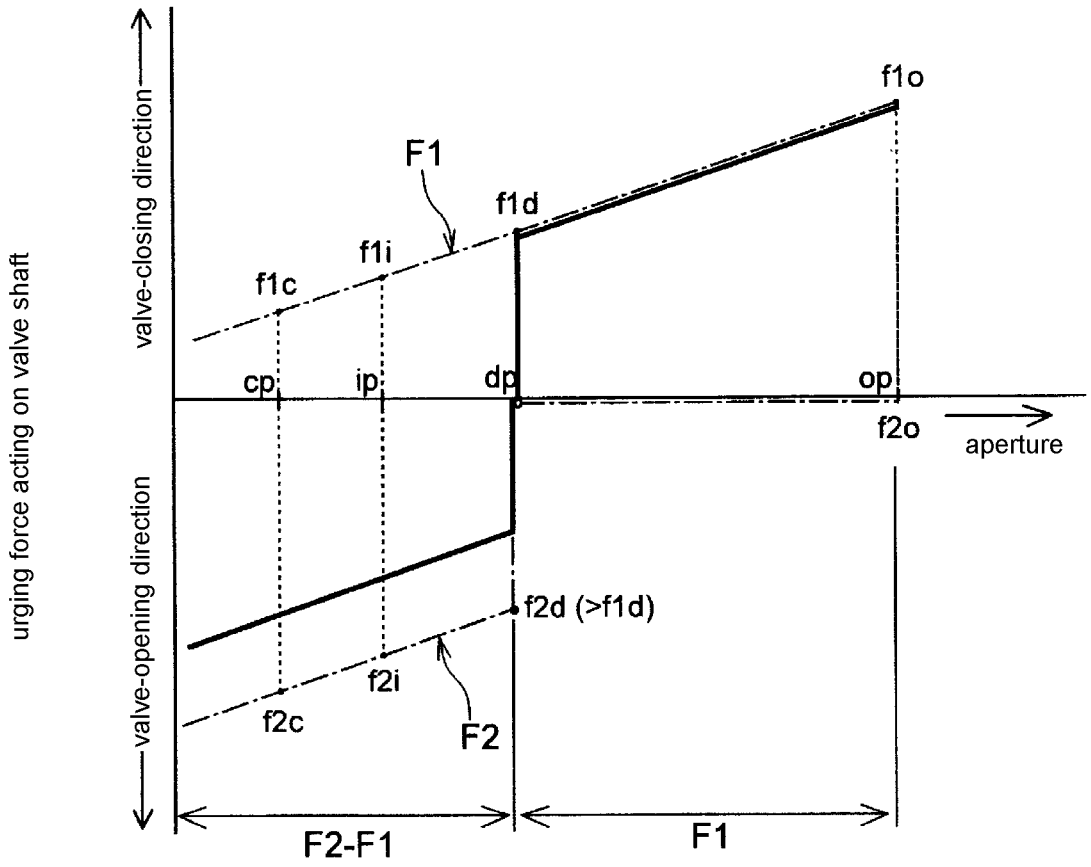
FIG. 9 is a graph showing an urging force applied on the valve shaft by the first urging spring and the second urging spring in the default mechanism included in the throttle device of one embodiment.

In the default mechanism M of the above throttle device, the first urging spring 70 and the second urging spring 80 respectively apply an urging force F1 and an urging force F2 as shown in FIG. 9 to the valve shaft 30.

The first urging spring 70 always applies the urging force F1 to the valve shaft 30 in the valve-closing direction CR.

That is, the first urging spring 70 applies, to the valve shaft 30, a smallest urging force f1*c* at a fully closed position cp, a largest urging force f1*o* at a fully open position op, an urging force f1*i* (>f1*c*) at an idling position ip, and an urging force f1*d* (f1*i*<f1*d*<f1*o*) at a default position dp.

The second urging spring 80 does not apply an urging force to the valve shaft 30 among the default position dp to the fully open position op, and applies the urging force F2 in the valve-opening direction OR at a position having an aperture smaller than that of the default position dp.

That is, the second urging spring 80 applies, to the valve shaft 30, a largest urging force f2*c* at the fully closed position cp and an urging force f2*i* (<f2*c*) at the idling position ip, and does not apply an urging force among the default position dp to the fully open position op.

Accordingly, the urging forces (F2-F1) act on the valve shaft 30 in the valve-opening direction OR among the fully closed position cp to the default position dp, and the urging force F1 acts on the valve shaft 30 in the valve-closing direction CR among the default position dp to the fully open position op.

In addition, the second urging spring 80 is set at the default position dp where the rotation of the rotation holder 60 is limited by the adjustment screw 90, so as to apply a urging force f2*d* greater than the urging force f1*d* of the first urging spring 70 to the rotation gear 50 to draw the rotation gear 50 to the rotation holder 60.

Accordingly, even if the rotation gear 50 is about to rotate in the valve-closing direction CR due to the intake pressure or the like when the drive source 100 is not operating, the urging force f2*d* of the second urging spring 80 is greater than the urging force f1*d* of the first urging spring 70, and thus the engagement between the protrusion portion 56 of the rotation gear 50 and the protrusion portion 64 of the rotation holder 60 is maintained, and the throttle valve 40 can be reliably stopped and positioned at the default position dp.

Besides, even if the urging force f2*d* and the urging force f1*d* antagonize with the same value, the engagement state between the protrusion portion 56 of the rotation gear 50 and the protrusion portion 64 of the rotation holder 60 can be maintained.

Figure 10:
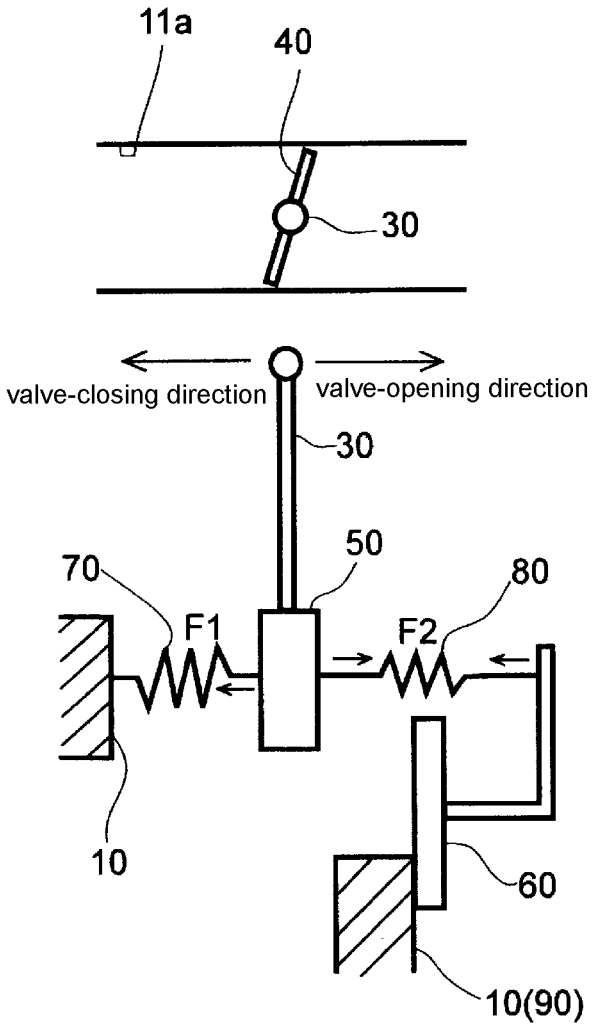
FIG. 10 is a schematic diagram showing a state in which the throttle valve is at a fully closed position in the throttle device of the present invention.
Figure 11:
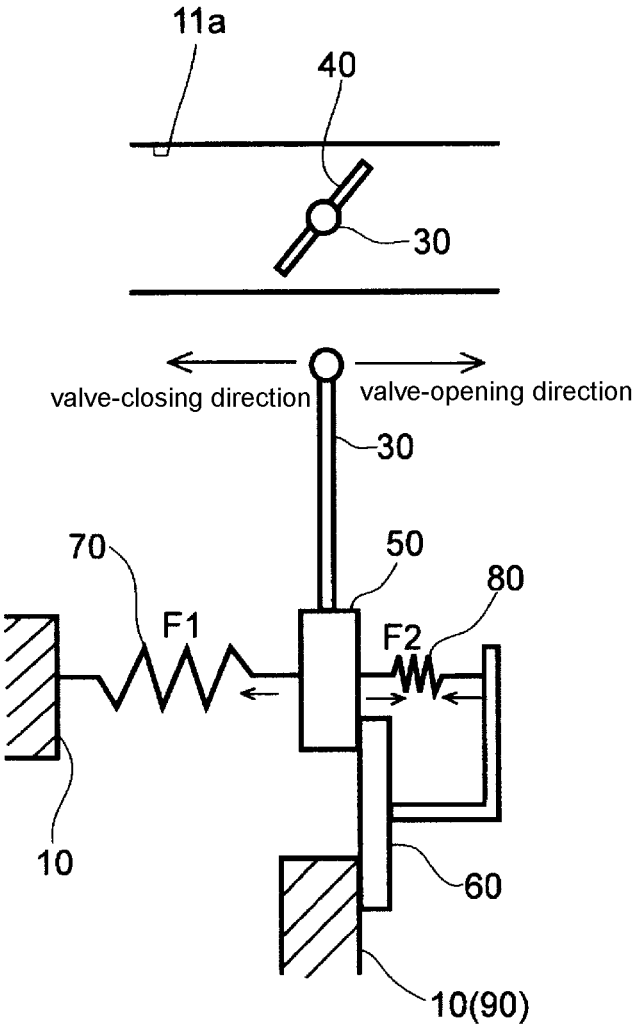
FIG. 11 is a schematic diagram showing a state in which the throttle valve is at a default position in the throttle device of the present invention.

According to the default mechanism M, when the drive force of the drive source 100 acts in the region from the fully closed position to the default position, as shown in FIGS. 10 and 11, the rotation gear 50 is caused to rotate by the drive force of the drive source 100, in a state that the rotation of the rotation holder 60 is limited by the adjustment screw 90 and a urging force (F2-F1) obtained by subtracting the urging force F1 of the first urging spring 70 from the urging force F2 of the second urging spring 80 acts in the valve-opening direction OR.

Figure 12:
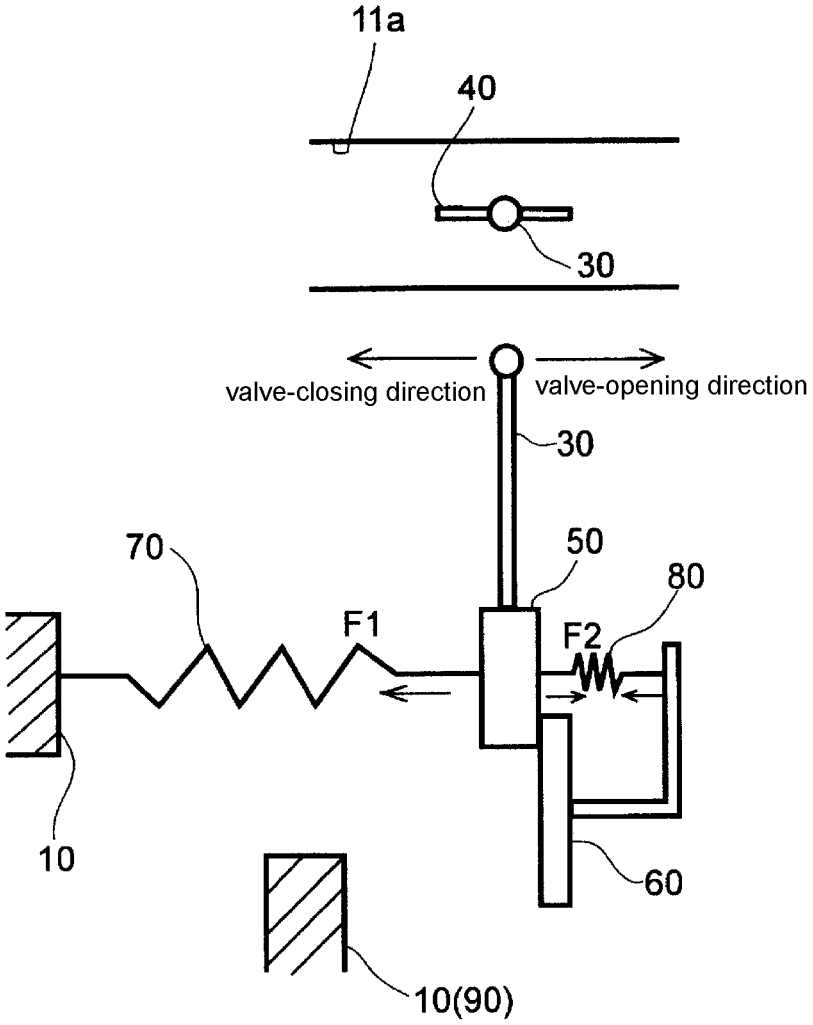
FIG. 12 is a schematic diagram showing a state in which the throttle valve is at a fully open position in the throttle device of the present invention.

In addition, when the drive force of the drive source 100 acts in the region from the default position to the fully open position, as shown in FIGS. 11 and 12, the rotation gear 50 is caused, by the drive force of the drive source 100, to rotate together with the rotation holder 60, in a state that the urging force F2 of the second urging spring 80 does not act and the urging force F1 of the first urging spring 70 acts in the valve-closing direction CR.

On the other hand, when the drive force of the drive source 100 does not act in the region from the default position to the fully open position, as shown in FIGS. 11 and 12, the urging force F1 of the first urging spring 70 acts and the rotation gear 50 is rotated together with the rotation holder 60 in the valve-closing direction CR, and the rotation gear 50 stops at the default position because the rotation of the rotation holder 60 is limited by the adjustment screw 90.

In addition, when the drive force of the drive source 100 does not act in the region from the fully closed position to the default position, as shown in FIGS. 10 and 11, the urging force (F2-F1) obtained by subtracting the urging force F1 of the first urging spring 70 from the urging force F2 of the second urging spring 80 acts in the valve-opening direction OR, and the rotation gear 50 engages with the rotation holder 60 limited by the adjustment screw 90 and stops at the default position.

In this way, when the drive force of the drive source 100 does not act on the rotation gear 50, as shown in FIG. 11, the rotation gear 50, that is, the throttle valve 40 is automatically positioned at the default position.

As described above, in the default mechanism M, the first urging spring 70 and the second urging spring 80 are disposed around the valve shaft 30, and thus it is possible to achieve the integration of components and the reduction in device size.

In addition, the first urging spring 70 and the second urging spring 80 are disposed in a nested shape around the axis S of the valve shaft 30.

Accordingly, it is possible to achieve the integration of components and the reduction in device width and size in the direction of the axis S of the valve shaft 30.

Furthermore, the first urging spring 70 and the second urging spring 80 are disposed to be covered between the rotation gear 50 and the wall portion of the body 10, and thus interference with other components, biting of foreign matter or the like is prevented, and a predetermined urging force can be exerted.

In addition, according to the throttle device, since the rotation gear 50, the rotation holder 60, the first urging spring 70, the second urging spring 80, and the adjustment screw 90 serving as a defining portion of the body 10 are employed as the default mechanism M, it is possible to easily set and adjust the default position, and to achieve the integration of components, the reduction in device size, and the like.

Furthermore, the default mechanism M is disposed in the recess 14 of the body 10, and the position sensor PS is disposed in the recess 14 and the cover 20 that covers the recess 14.

That is, the default mechanism D and the position sensor PS are disposed on one side of the body 10. Thereby, it is possible to achieve the integration of components, the simplification of device outline, the reduction in device size, and the like.

Next, the operation of a vehicle equipped with an engine including the above throttle device is described.

Figure 14:
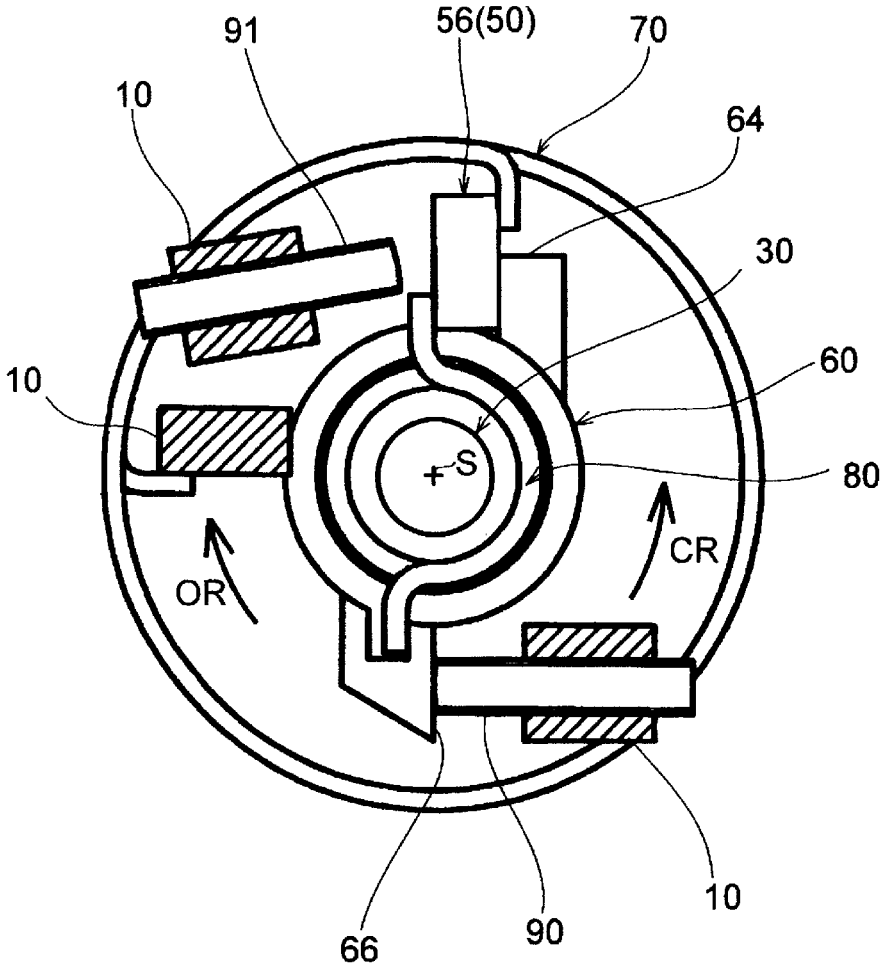
FIG. 14 is an operation diagram showing a state in which the throttle valve is at the default position in the throttle device of the present invention.

First, during the non-operation of the drive source 100 in which the drive force is not applied, the rotation gear 50 and the valve shaft 30 are caused, by the urging force of the first urging spring 70, to rotate together with the rotation holder 60 in the valve-closing direction CR, and as shown in FIG. 14, the contact portion 66 of the rotation holder 60 comes into contact with the adjustment screw 90, and the further rotation is limited. Thereby, the throttle valve 40 is positioned at the default position.

Figure 13:
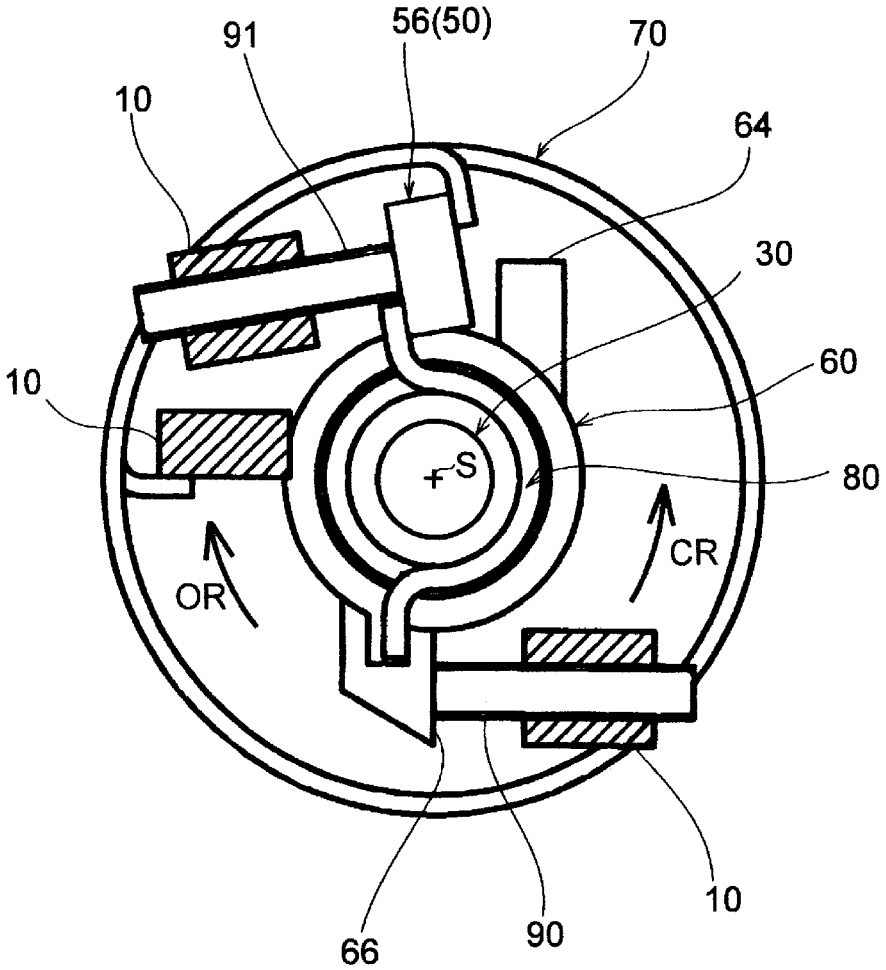
FIG. 13 is an operation diagram showing a state in which the throttle valve is at the fully closed position in the throttle device of the present invention.

In this stop state, when the engine is started smoothly as the engine is turned on, and the engine is in an idling operation state in response to the accelerator or throttle operation on the vehicle side, the drive source 100 rotates in one direction, and the throttle valve 40 is positioned at the idling position having an aperture smaller than that of the default position shown in FIG. 14 and larger than that of the fully closed position shown in FIG. 13.

At this time, the contact portion 66 comes into contact with the adjustment screw 90 and the rotation of the rotation holder 60 is limited. The protrusion portion 56 is detached from the protrusion portion 64 and the rotation gear 50 rotates in the valve-closing direction CR against the urging force of the second urging spring 80 and is held at the idling position.

On the other hand, when the engine is in a high-load operation state in response to the accelerator or throttle operation on the vehicle side, the drive source 100 rotates in another direction, and the throttle valve 40 is rotated from the idling position via the default position toward the fully open position.

Figure 15:
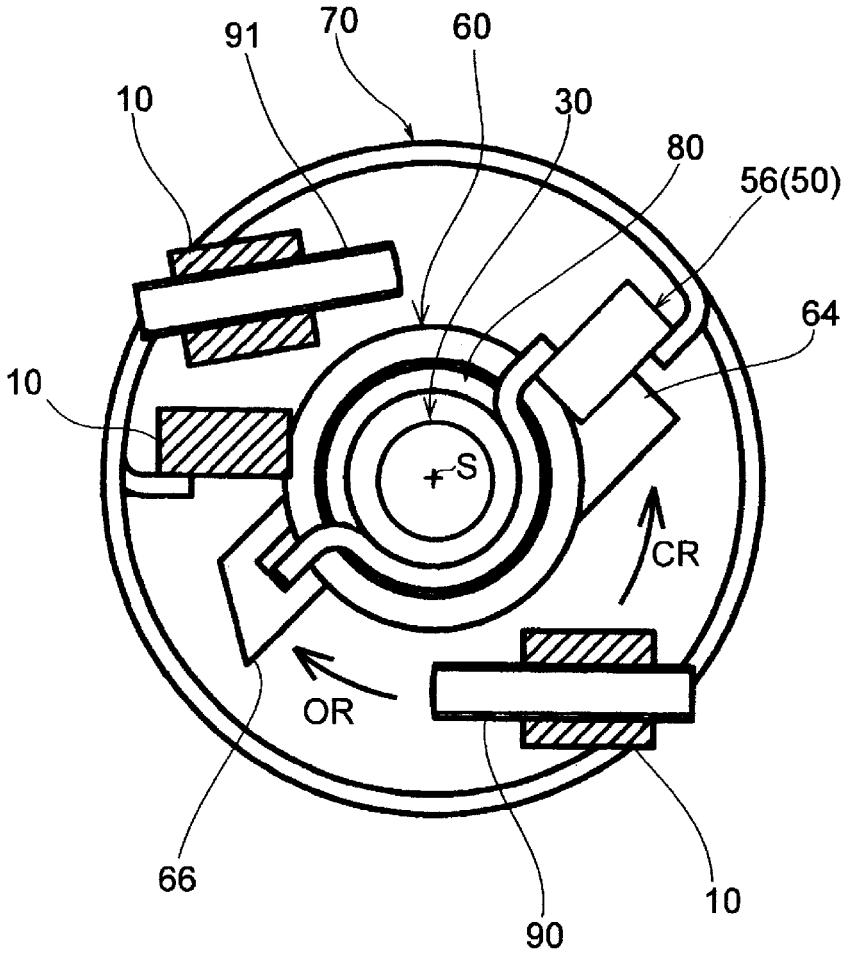
FIG. 15 is an operation diagram showing a state in which the throttle valve is at the fully open position in the throttle device of the present invention.

At this time, the rotation gear 50 rotates in the valve-opening direction OR, and as shown in FIG. 14, the protrusion portion 56 engages with the protrusion portion 64 at the default position. As shown in FIG. 15, the rotation gear 50 and the rotation holder 60 rotate together in the valve-opening direction OR in the range from the default position to the fully open position.

In addition, when the engine is in a low-load operation state in the range from the fully open position to the default position in response to the accelerator or throttle operation on the vehicle side, the drive source 100 rotates in one direction, and as shown in FIG. 15→FIG. 14, the throttle valve 40 is rotated from the fully open position toward the default position.

At this time, the rotation gear 50 and the rotation holder 60 rotate together in the valve-closing direction CR while the engagement between the protrusion portion 56 and the protrusion portion 64 is maintained.

Meanwhile, when the drive source 100 fails and no longer applies the drive force in the operation state in the range from the default position to the fully open position, as shown in FIG. 15→FIG. 14, the urging force F1 of the first urging spring 70 acts on the rotation gear 50 and the valve shaft 30 and causes the two to rotate together with the rotation holder 60 in the valve-closing direction CR. The contact part 66 of the rotation holder 60 comes into contact with the adjustment screw 90 and further rotation is limited.

Thereby, the throttle valve 40 is stopped and positioned at the default position, an operation state in which the vehicle can run automatically is reached, and a safe evacuation operation can be performed.

According to the above default mechanism M, since the default position can be maintained with particularly high precision at a predetermined position that is set in advance, safety can be further improved compared with the conventional technology in which variation of the default position is concerned.

On the other hand, when the drive source 100 fails and no longer applies the drive force in the operation state in the range from the idling position to the default position, as shown in FIG. 13→FIG. 14, the urging force (F2-F1) obtained by subtracting the urging force F1 of the first urging spring 70 from the urging force F2 of the second urging spring 80 acts on the rotation gear 50 and the valve shaft 30, and the rotation gear 50 and the valve shaft 30 are rotated in the valve-opening direction OR. The protrusion portion 56 engages with the protrusion portion 64 and further rotation of the rotation gear 50 and the valve shaft 30 is limited.

Thereby, the throttle valve 40 is stopped and positioned at the default position, the operation state in which the vehicle can run automatically is reached, and a safe evacuation operation can be performed.

Figure 16:
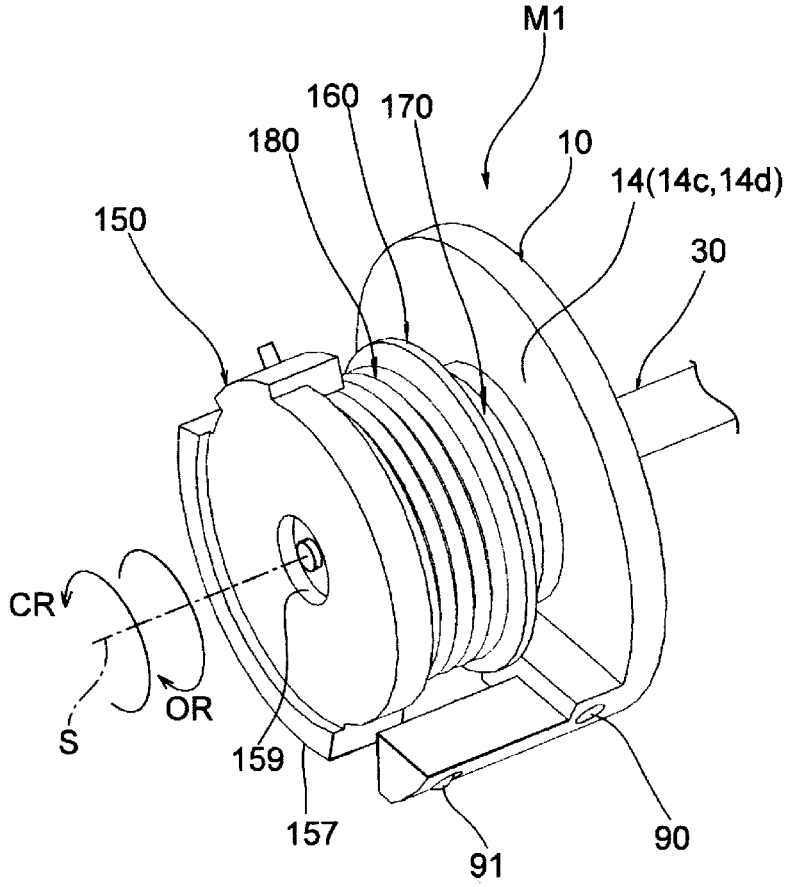
FIG. 16 is a perspective view showing another embodiment of the default mechanism included in the throttle device of the present invention, and showing a body that is partially cut off.
Figure 17:
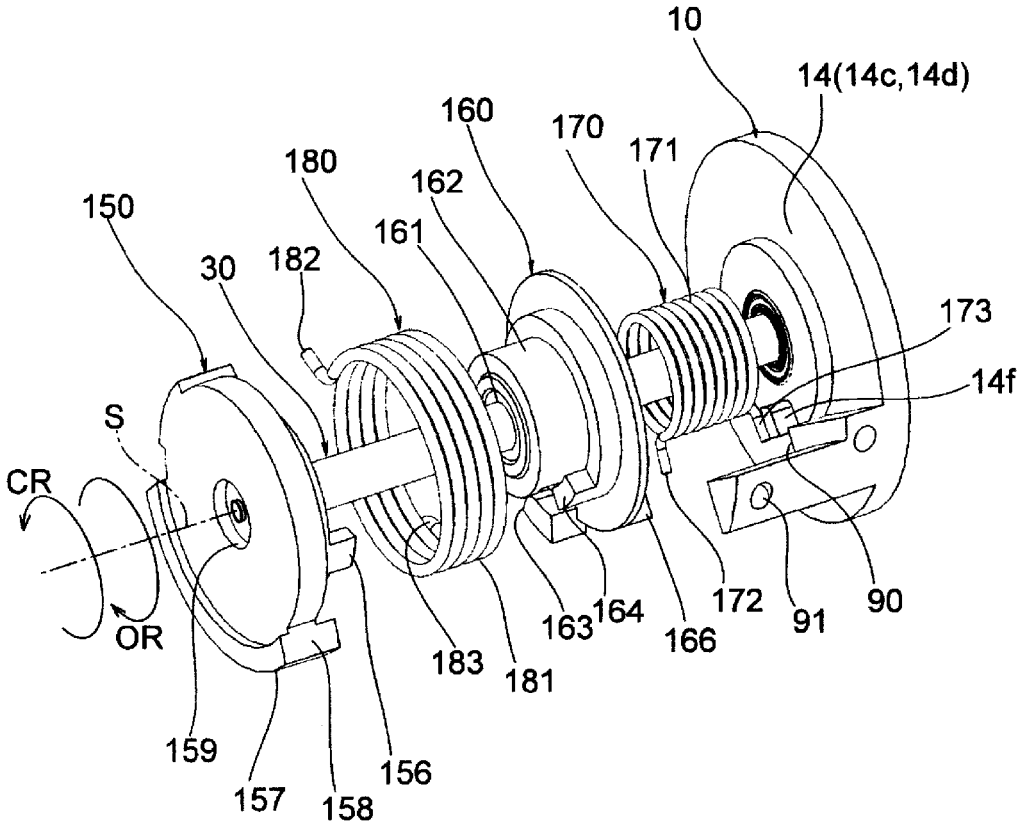
FIG. 17 is an exploded perspective view showing a part of the body, a valve shaft, a first rotation body, a second rotation body, a first urging spring, and a second urging spring in the default mechanism shown in FIG. 16.
Figure 18:
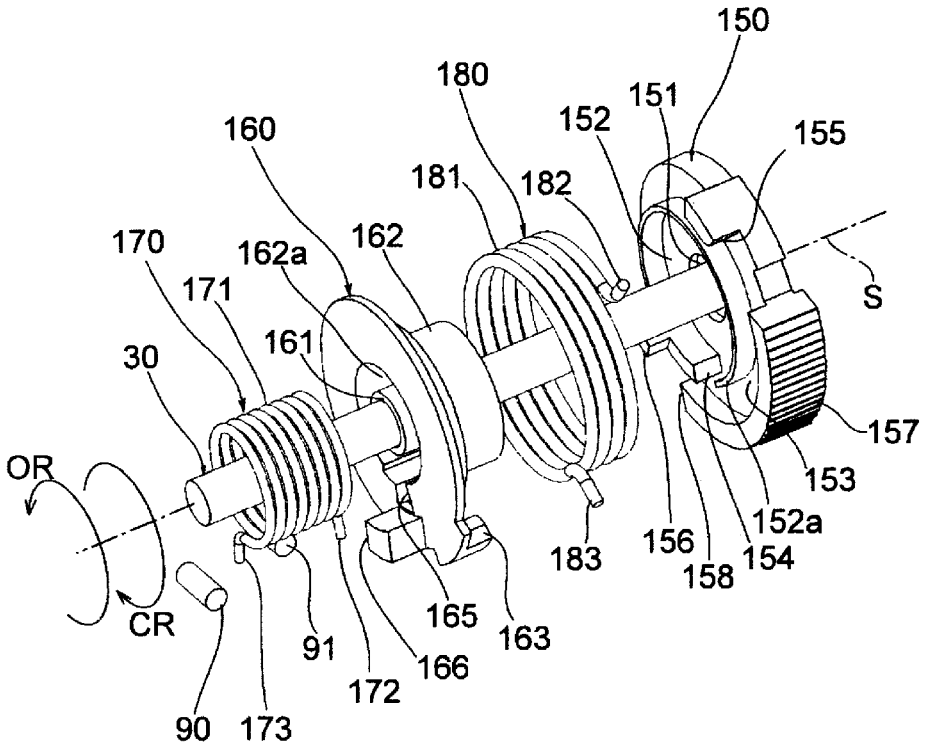
FIG. 18 is an exploded perspective view showing the valve shaft, the first rotation body, the second rotation body, the first urging spring, and the second urging spring in the default mechanism shown in FIG. 16.

FIGS. 16 to 18 show another embodiment of the default mechanism included in the throttle device of the present invention, and the same configurations as those in the above embodiment are denoted by the same reference signs and the description is omitted. In addition, the action of the default mechanism is basically the same as that of the above embodiment, and thus the description thereof is omitted.

A default mechanism M1 of the embodiment includes a rotation gear 150 serving as a first rotation body, a rotation holder 160 serving as a second rotation body, a first urging spring 170, a second urging spring 180, and an adjustment screw 90 serving as a defining portion.

The rotation gear 150 is formed of a resin material or the like and rotates integrally with the valve shaft 30 with a drive force applied to the rotation gear 150 by the drive mechanism D.

The rotation gear 150 includes a fixation portion 151, a recess 152, a recess 153, a latching portion 154 serving as a first latching portion, a latching portion 155 serving as a second latching portion, a protrusion portion 156 serving as a first engagement portion, a teeth row 157 serving as a transmission portion, a contact portion 158, and a joining portion 159 which joins the rotor portion PS2 of the position sensor PS.

Here, the fixation portion 151 is the same as the fixation portion 51 described above, the teeth row 157 is the same as the teeth row 57 described above, the contact portion 158 is the same as the contact portion 58 described above, and the joining portion 159 is the same as the joining portion 59 described above.

The recess 152 is formed to be recessed in the direction of the axis S with respect to the teeth row 157, and receives a cylindrical portion 162 of a rotation holder 160 in an annular shape centering on the axis S.

The recess 153 is formed to be recessed in the direction of the axis S with respect to the teeth row 157 and is formed in an annular shape centering on the axis S to face the body 10 side, receiving a part of a coil portion 181 of the second urging spring 180.

In this way, by arranging the recess 152 and the recess 153, the cylindrical portion 162 which accommodates the coil portion 171 of the first urging spring 170 is received by the recess 152, and the coil portion 181 of the second urging spring 180 is received by the recess 153. Accordingly, the first urging spring 170 and the second urging spring 180 can be disposed to overlap the rotation gear 150 in the direction of the axis S of the valve shaft 30. Therefore, it is possible to achieve reduction in device width in the direction of the axis S of the valve shaft 30.

The latching portion 154 is formed by cutting out a part of an outer peripheral wall 152*a* defining the recess 152 so as to latch one end 172 of the first urging spring 170.

The latching portion 155 is formed protruding in the direction of the axis S so as to latch one end 182 of the second urging spring 180.

The protrusion portion 156 is formed to extend in the direction of the axis S so as to detachably engage with a protrusion portion 164 serving as a second engagement portion of the rotation holder 160 around the axis S.

Besides, the protrusion portion 156 can engage with the protrusion portion 164 of the rotation holder 160 when the rotation gear 150 rotates in the valve-opening direction OR, and can be detached from the protrusion portion 164 of the rotation holder 160 when the rotation gear 150 rotates in the valve-closing direction CR.

The rotation holder 160 is formed of a resin material or the like, and the rotation holder 160 can rotate relative to the valve shaft 30 and engages with the adjustment screw 90 serving as a defining portion when rotating in the valve-closing direction CR to limit the further rotation in the valve-closing direction CR.

The rotation holder 160 includes a cylindrical hole 161, a ring-like groove 162*a* defined on the inner side of the cylindrical portion 162, a latching portion 163 serving as a fourth latching portion, the protrusion portion 164 serving as a second engagement portion, a cutout 165, and a contact portion 166 which comes into contact with the adjustment screw 90 serving as a defining portion.

The valve shaft 30 is rotatably fitted into the cylindrical hole 161.

That is, the rotation holder 160 is rotatably supported relative to the valve shaft 30 by passing the valve shaft 30 through the cylindrical hole 161.

The cylindrical portion 162 is formed to be received by the recess 152 of the rotation gear 150, and defines the ring-like groove 162*a* on the inner side thereof and around the cylindrical hole 161.

The ring-like groove 162*a* is formed to receive a part of a coil portion 171 of the first urging spring 170.

The latching portion 163 is formed protruding in the direction of the axis S so as to latch the other end 183 of the second urging spring 180.

The protrusion portion 164 is formed to extend in the direction of the axis S so as to detachably engage with the protrusion portion 156 of the rotation gear 150 around the axis S.

Besides, the protrusion portion 164 can engage with the protrusion portion 156 of the rotation gear 150 when the rotation holder 160 rotates in the valve-closing direction CR, and can be detached from the protrusion portion 156 of the rotation gear 150 when the rotation holder 160 rotates in the valve-opening direction OR.

The cutout 165 is formed that the one end 172 of the first urging spring 170 passes through the cutout 165 to be movably received in a predetermined range around the axis S and be guided to the latching portion 154 of the rotation gear 150.

The contact portion 166 is the same as the contact portion 66 described above.

That is, the rotation holder 160 is rotatably supported by the valve shaft 30 and accommodated in the accommodation recess 14*c* of the body 10, and receives and holds the first urging spring 170 in the ring-like groove 162*a*.

Accordingly, since the coil portion 171 of the first urging spring 170 is received by the ring-like groove 162*a* of the rotation holder 160, the first urging spring 70 and the rotation holder 160 can be disposed to overlap each other in the direction of the axis S of the valve shaft 30, and it is possible to achieve the reduction in width in the direction of the axis S of the valve shaft 30.

The first urging spring 170 is a small-diameter torsion coil spring interposed between the rotation gear 150 and the body 10, and includes the coil portion 171, one end 172, and the other end 173.

Besides, the first urging spring 170 is disposed on the inner side of the second urging spring 180 which is disposed around the valve shaft 30 and around the cylindrical portion 162 of the rotation holder 160, and the one end 172 is latched by the latching portion 154 of the rotation gear 150 and the other end 173 is latched by the latching portion 14*f* of the body 10 in a state that the coil portion 171 is accommodated in the ring-like groove 162*a* of the rotation holder 160.

Thereby, the first urging spring 170 rotates and urges the rotation gear 150 and the valve shaft 30 in the valve-closing direction CR with respect to the body 10.

The second urging spring 180 is a large-diameter torsion coil spring interposed between the rotation gear 150 and the rotation holder 160, and includes the coil portion 181, one end 182, and the other end 183.

Besides, in the second urging spring 180, the coil part 181 is disposed around the valve shaft 30 and around the cylindrical portion 162 of the rotation holder 160, the one end 182 is latched by the latching portion 155 of the rotation gear 150, and the other end 183 is latched by the latching portion 163 of the rotation holder 160.

Thereby, the second urging spring 180 rotates and urges so as to draw the rotation gear 150 in the valve-opening direction OR and draw the rotation holder 160 in the valve-closing direction CR to engage the protrusion portion 156 of the rotation gear 150 with the protrusion portion 164 of the rotation holder 160.

In addition, the second urging spring 180 applies a rotational urging force to maintain the engagement between the protrusion portion 156 and the protrusion portion 164 during the non-operation of the drive source 100 in which the drive force is not applied.

According to the first urging spring 170 and the second urging spring 180, the rotation gear 150 is rotated and urged in the valve-closing direction CR by the first urging spring 170, and thus the rotation holder 160 that engages with and rotates together with the rotation gear 150 is rotated and urged so that the rotation holder 160 rotates in the valve-closing direction CR and the contact portion 166 thereof comes into contact with the adjustment screw 90 of the body 10.

In this way, the contact portion 166 comes into contact with the adjustment screw 90 and thereby the throttle valve 40 is positioned at the default position.

According to the throttle device including the default mechanism M1, the first urging spring 170 is disposed in a nested shape on the inner side of the second urging spring 180 around the axis S.

Accordingly, it is possible to achieve the integration of components, the reduction in device size, and the like in the direction of the axis S. In addition, similar to the above embodiment, it is possible to easily set and adjust the default position and to achieve the integration of components and the reduction in device size.

Furthermore, according to the vehicle equipped with the engine including the throttle device, an operation state in which the vehicle can run automatically is reached in the same manner as above, and a safe evacuation operation can be performed.

In addition, as described above, the default position can be maintained with high precision at a predetermined position that is set in advance, safety can be further improved compared with the conventional technology in which variation of the default position is concerned.

Figure 19:
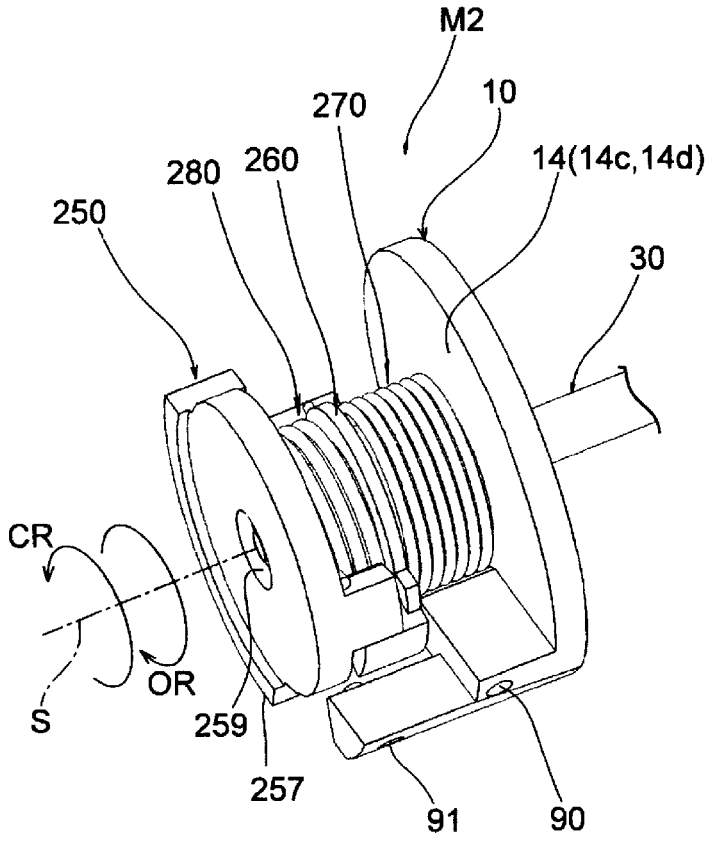
FIG. 19 is a perspective view showing still another embodiment of the default mechanism included in the throttle device of the present invention, and showing a body that is partially cut off.
Figure 20:
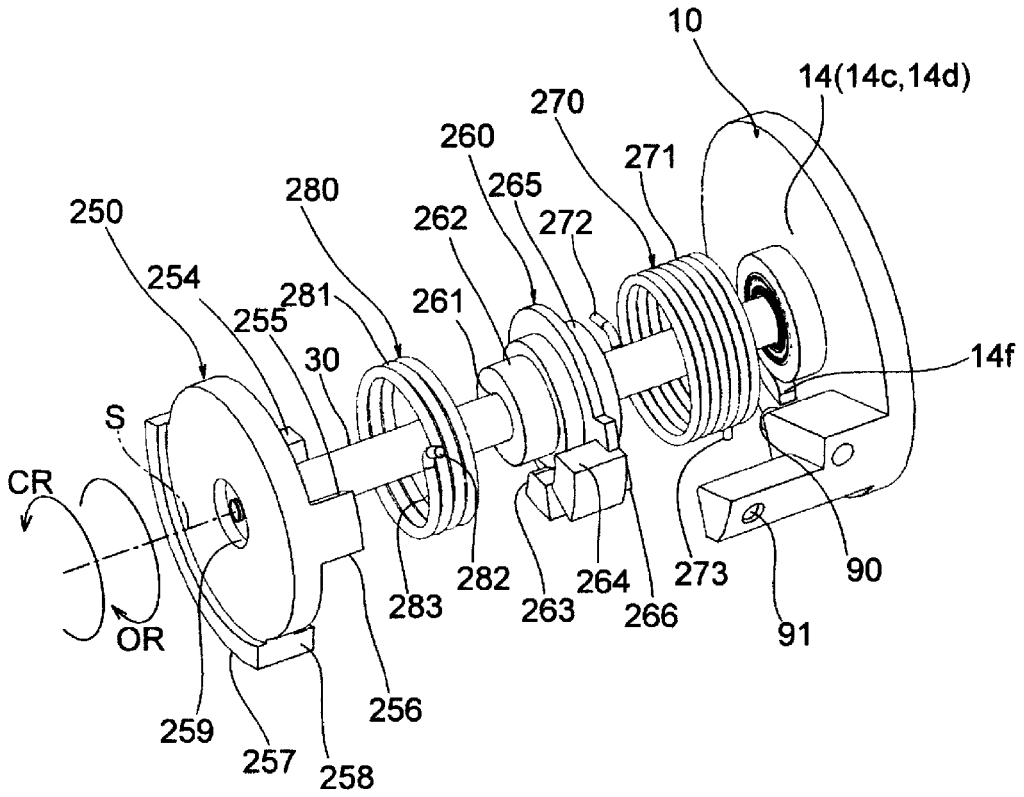
FIG. 20 is an exploded perspective view showing a part of the body, a valve shaft, a first rotation body, a second rotation body, a first urging spring, and a second urging spring in the default mechanism shown in FIG. 19.
Figure 21:
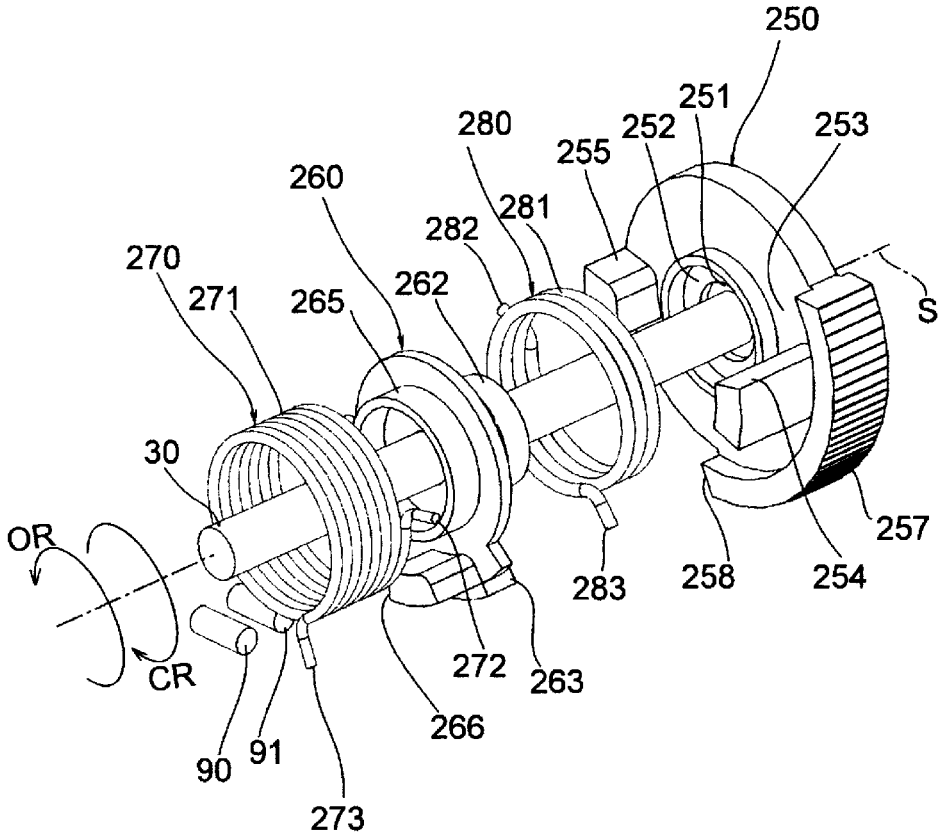
FIG. 21 is an exploded perspective view showing the valve shaft, the first rotation body, the second rotation body, the first urging spring, and the second urging spring in the default mechanism shown in FIG. 19.

FIGS. 19 to 21 show still another embodiment of the default mechanism included in the throttle device of the present invention. The same configurations as those in the above embodiment are denoted by the same reference signs and the description is omitted. In addition, the action of the default mechanism is also basically the same as that of the above embodiment, and thus the description thereof is omitted. A default mechanism M2 of the embodiment includes a rotation gear 250 serving as a first rotation body, a rotation holder 260 serving as a second rotation body, a first urging spring 270, a second urging spring 280, and an adjustment screw 90 serving as a defining portion.

The rotation gear 250 is formed of a resin material or the like and rotates integrally with the valve shaft 30 with a drive force applied to the rotation gear 250 by the drive mechanism D.

The rotation gear 250 includes a fixation portion 251, a recess 252, a recess 253, a latching portion 254 serving as a first latching portion, a latching portion 255 serving as a second latching portion, a protrusion portion 256 serving as a first engagement portion, a teeth row 257 serving as a transmission portion, a contact portion 258, and a joining portion 259 which joins the rotor portion PS2 of the position sensor PS.

Here, the fixation portion 251 is the same as the fixation portion 51 described above, the teeth row 257 is the same as the teeth row 57 described above, the contact portion 258 is the same as the contact portion 58 described above, and the joining portion 259 is the same as the joining portion 59 described above.

The recess 252 is formed to be recessed in the direction of the axis S with respect to the teeth row 257, and receives a cylindrical portion 262 of the rotation holder 260 in an annular shape centering on the axis S.

The recess 253 is formed to be recessed in the direction of the axis S with respect to the teeth row 257 and is formed in an annular shape around the axis S to face the body 10 side, receiving a part of a coil portion 281 of the second urging spring 280.

In this way, by arranging the recess 252 and the recess 253, the cylindrical portion 262 of the rotation holder 260 is received by the recess 252, and the coil portion 281 of the second urging spring 280 is received by the recess 253. Accordingly, the rotation holder 260 and the second urging spring 280 can be disposed adjacent to or disposed to overlap the rotation gear 250 in the direction of the axis S of the valve shaft 30. Therefore, it is possible to achieve the reduction in device width in the direction of the axis S of the valve shaft 30.

The latching portion 254 is formed protruding in the direction of the axis S so as to latch one end 272 of the first urging spring 270. The latching portion 255 is formed protruding in the direction of the axis S so as to latch one end 282 of the second urging spring 280.

The protrusion portion 256 is formed to extend in the direction of the axis S in the same manner as the latching portion 254 so as to detachably engage with a protrusion portion 264 serving as a second engagement portion of the rotation holder 260 around the axis S.

Besides, the protrusion portion 256 can engage with the protrusion portion 264 of the rotation holder 260 when the rotation gear 250 rotates in the valve-opening direction OR, and can be detached from the protrusion portion 264 of the rotation holder 260 when the rotation gear 250 rotates in the valve-closing direction CR.

The rotation holder 260 is formed of a resin material or the like, and the rotation holder 260 can rotate relative to the valve shaft 30 and engages with the adjustment screw 90 serving as a defining portion when rotating in the valve-closing direction CR to limit the further rotation in the valve-closing direction CR.

The rotation holder 260 includes a cylindrical hole 261, the cylindrical portion 262, a latching portion 263 serving as a fourth latching portion, the protrusion portion 264 serving as a second engagement portion, a cylindrical portion 265, and a contact portion 266 which comes into contact with the adjustment screw 90 serving as a defining portion.

The valve shaft 30 is rotatably fitted into the cylindrical hole 261. That is, the rotation holder 260 is rotatably supported relative to the valve shaft 30 by passing the valve shaft 30 through the cylindrical hole 261.

The cylindrical portion 262 is received by the recess 252 of the rotation gear 250.

The engagement portion 263 is formed protruding in the direction of the axis S so as to engage the other end 283 of the second urging spring 280.

The protrusion portion 264 is formed to extend in the direction of the axis S so as to detachably engage with the protrusion portion 256 of the rotation gear 250 around the axis S.

Besides, the protrusion portion 264 can engage with the protrusion portion 256 of the rotation gear 250 when the rotation holder 260 rotates in the valve-closing direction CR, and can be detached from the protrusion portion 256 of the rotation gear 250 when the rotation holder 260 rotates in the valve-opening direction OR.

The cylindrical portion 265 is formed so that a coil portion 271 of the first urging spring 270 is disposed around the cylindrical portion 265, and the end surface of the cylindrical portion 265 faces the accommodation recess 14*c* of the body 10. The contact portion 266 is the same as the contact portion 66 described above.

That is, the rotation holder 260 is rotatably supported by the valve shaft 30 and is accommodated in the accommodation recess 14*c* of the body 10 with the first urging spring 270 interposed therebetween.

Accordingly, the first urging spring 270 and the rotation holder 260 can be disposed adjacent to each other or disposed to overlap each other in the direction of the axis S of the valve shaft 30, and it is possible to achieve the reduction in width in the direction of the axis S of the valve shaft 30.

The first urging spring 270 is a torsion coil spring having a predetermined diameter interposed between the rotation gear 250 and the body 10, and includes the coil portion 271, the one end 272, and the other end 273.

Besides, in the first urging spring 270, the coil portion 271 is disposed around the valve shaft 30 and around the cylindrical portion 265 of the rotation holder 260, the one end 272 is latched by the latching portion 254 of the rotation gear 250, and the other end 273 is latched by the latching portion 14*f* of the body 10.

Thereby, the first urging spring 270 rotates and urges the rotation gear 250 and the valve shaft 30 in the valve-closing direction CR with respect to the body 10.

The second urging spring 280 is a torsion coil spring that is interposed between the rotation gear 250 and the rotation holder 260 and has the same diameter as the first urging spring 270, and includes the coil portion 281, the one end 282, and the other end 283.

Besides, in the second urging spring 280, the coil portion 281 is disposed around the valve shaft 30 and around the cylindrical portion 262 of the rotation holder 260, the one end 282 is latched by the latching portion 255 of the rotation gear 250, and the other end 283 is latched by the latching portion 263 of the rotation holder 260.

Thereby, the second urging spring 280 rotates and urges so as to draw the rotation gear 250 in the valve-opening direction OR and draw the rotation holder 260 in the valve-closing direction CR to engage the protrusion portion 256 of the rotation gear 250 with the protrusion portion 264 of the rotation holder 260.

In addition, the second urging spring 280 applies a rotational urging force to maintain the engagement between the protrusion portion 256 and the protrusion portion 264 during the non-operation of the drive source 100 in which the drive force is not applied.

According to the first urging spring 270 and the second urging spring 280, the rotation gear 250 is rotated and urged in the valve-closing direction CR by the first urging spring 270, and thus the rotation holder 260 which engages with and rotates together with the rotation gear 250 is rotated and urged so that the rotation holder 260 rotates in the valve-closing direction CR and the contact portion 266 thereof comes into contact with the adjustment screw 90 of the body 10.

In this way, the contact portion 266 comes into contact with the adjustment screw 90 and thereby the throttle valve 40 is positioned at the default position.

According to the throttle device including the default mechanism M2, the first urging spring 170 and the second urging spring 180 are disposed adjacent to each other in the direction of the axis S with the same diameter.

Accordingly, it is possible to suppress the dimension in the radial direction perpendicular to the axis S and to achieve the reduction in device size and the like. In addition, similar to the above embodiment, it is possible to easily set and adjust the default position and to achieve the integration of components and the reduction in device size.

Furthermore, according to the vehicle equipped with the engine including the throttle device, an operation state in which the vehicle can run automatically is reached in the same manner as above, and a safe evacuation operation can be performed.

In addition, as described above, the default position can be maintained with high precision at a predetermined position that is set in advance, and safety can be further improved compared with the conventional technology in which variation of the default position is concerned.

In the above embodiments, the torsion coil spring is shown as the first urging spring and the second urging spring constituting the default mechanisms M, M1, M2, but the present invention is not limited hereto, and other urging springs may also be applied as long as a desired urging force is exerted.

In addition, the rotation gears 50, 150, 250 and the rotation holders 60, 160, 260 are shown as the first rotation body and the second rotation body, but the present invention is not limited hereto, and rotation bodies of other forms may also be employed. In addition, the aperture position at which the vehicle can run automatically is referred to as the default position, and the mechanism positioned at the default position is referred to as the default mechanism, but the present invention is not limited to these names, and a limp home position or a limp home aperture may be used as another name in response to the default position and a limp home mechanism may be used as another name in response to the default mechanism.

In the above embodiments, the drive mechanism D including the drive source 100, the drive gear 110, and the two-step gear 120 is shown as the drive mechanism, but the present invention is not limited hereto, and other drive mechanisms may also be employed.

In addition, the non-contact type position sensor PS is shown as the position sensor, but the present invention is not limited hereto, and the position sensor may be a contact type position sensor. Besides, position sensors on the basis of detection types other than magnetic detection may also be employed.

As described above, the throttle device of the present invention can easily set and adjust the default position and can achieve the integration of components and the reduction in device size, and thus is not only applicable to a throttle device for an engine mounted on a motorcycle, an automobile or the like but also useful in vehicles on which other engines are mounted.

REFERENCE SIGNS LIST

M, M1, M2 default mechanism
D drive mechanism
PS position sensor
S axis
CR valve-closing direction
OR valve-opening direction
10 body
11*a* intake passage
14*c* accommodation recess
14*d* ring-like recess
14*f* latching portion (third latching portion)
30 valve shaft
40 throttle valve
50, 150, 250 rotation gear (first rotation body)
52, 53, 152, 153, 252, 253 recess
54, 154, 254 latching portion (first latching portion)
55, 155, 255 latching portion (second latching portion)
56, 156, 256 protrusion portion (first engagement portion)
57, 157, 257 teeth row (transmission portion)
60, 160, 260 rotation holder (second rotation body)
62, 162*a* ring-like groove
63, 163, 263 latching portion (fourth latching portion)
64, 164, 264 protrusion portion (second engagement portion)
66, 166, 266 contact portion
70, 170, 270 first urging spring
71, 171, 271 coil portion
72, 172, 272 one end
73, 173, 273 the other end
80, 180, 280 second urging spring
81, 181, 281 coil portion
82, 182, 282 one end
83, 183, 283 the other end
90 adjustment screw (defining portion)
100 drive source

What is claimed is:

1. A throttle device, comprising:
a body which defines an intake passage,
a valve shaft rotatably supported by the body,
a throttle valve fixed to the valve shaft to open and close the intake passage,
a drive source which applies a drive force to the valve shaft, and
a default mechanism which positions the throttle valve at a default position between a fully closed position and a fully open position;
wherein the default mechanism comprises:
a defining portion arranged on the body to define the default position;
a stopper arranged on the body to define a fully closed position;
a first rotation body which rotates integrally with the valve shaft and comprises a first contact portion which detachably comes into contact with the stopper;
a second rotation body which can rotate relative to the valve shaft and which engages with the defining portion to limit the rotation in a valve-closing direction and comprises a second contact portion which detachably comes into contact with the defining portion;
a first urging spring which is interposed between the first rotation body and the body and urges the first rotation body in the valve-closing direction; and
a second urging spring which is interposed between the first rotation body and the second rotation body, and urges so as to draw the first rotation body in a valve-opening direction and draw the second rotation body in the valve-closing direction to engage the two with each other and to maintain the engagement during the non-operation of the drive source.

2. The throttle device according to claim 1,
wherein the urging force of the second urging spring is set larger than the urging force of the first urging spring at the default position where the rotation of the second rotation body is limited by the defining portion.

3. The throttle device according to claim 1,
wherein the first urging spring and the second urging spring are torsion coil springs disposed around the valve shaft.

4. The throttle device according to claim 3,
wherein the first urging spring and the second urging spring are disposed in a nested shape around an axis of the valve shaft or disposed adjacently in an axial direction of the valve shaft.

5. The throttle device according to claim 3,
wherein the body comprises an accommodation recess which accommodates the second rotation body,
the second rotation body is rotatably supported by the valve shaft and disposed in the accommodation recess, and
the first rotation body is disposed to face the body and the second rotation body.

6. The throttle device according to claim 5,
wherein the first rotation body comprises a first latching portion which latches one end of the first urging spring, a second latching portion which latches one end of the second urging spring, and a first engagement portion detachably engaged with the second rotation body;
the body comprises a third latching portion which latches the other end of the first urging spring; and
the second rotation body comprises a fourth latching portion which latches the other end of the second urging spring, a second engagement portion detachably engaged with the first engagement portion of the first rotation body.

7. The throttle device according to claim 6,
wherein the body comprises a ring-like recess which receives a coil portion of the first urging spring or a coil portion of the second urging spring, and
the second rotation body comprises a ring-like groove which receives the coil portion of the first urging spring or the coil portion of the second urging spring.

8. The throttle device according to claim 5,
wherein the first rotation body comprises a recess which receives the coil portion of the first urging spring, and a recess which receives the coil portion of the second urging spring.

9. The throttle device according to claim 1,
wherein the defining portion is an adjustment screw screwed to the body.

10. The throttle device according to claim 1,
wherein the first rotation body comprises a transmission portion with which the drive force of the drive source is transmitted.

11. The throttle device according to claim 1, comprises
a position sensor which detects an aperture position of the throttle valve,
wherein the position sensor and the default mechanism are disposed on one side of the body.

* * * * *